US011224846B2

(12) United States Patent
Selirio et al.

(10) Patent No.: US 11,224,846 B2
(45) Date of Patent: Jan. 18, 2022

(54) STATIC MIXER FOR FLUID FLOW IN A PIPELINE

(71) Applicant: Canada Pipeline Accessories Co., Ltd., Calgary (CA)

(72) Inventors: Reginald Selirio, Calgary (CA); Raphael Selirio, Calgary (CA); Daniel Sawchuk, Chestermere (CA)

(73) Assignee: Canada Pipeline Accessories Co., Ltd., Calgary (CA)

( * ) Notice: Subject to any disclaimer, the term of this patent is extended or adjusted under 35 U.S.C. 154(b) by 0 days.

(21) Appl. No.: 16/743,040

(22) Filed: Jan. 15, 2020

(65) Prior Publication Data

US 2020/0149687 A1 May 14, 2020

Related U.S. Application Data

(63) Continuation of application No. 16/069,182, filed as application No. PCT/CA2017/051153 on Sep. 29, 2017, now Pat. No. 10,619,797.

(60) Provisional application No. 62/432,732, filed on Dec. 12, 2016, provisional application No. 62/506,668, filed on May 16, 2017.

(51) Int. Cl.
*B01F 5/06* (2006.01)
*B01F 13/10* (2006.01)

(52) U.S. Cl.
CPC ..... *B01F 5/061* (2013.01); *B01F 5/0618* (2013.01); *B01F 13/1016* (2013.01); *B01F 2005/0622* (2013.01); *B01F 2005/0639* (2013.01)

(58) Field of Classification Search
CPC ..... B01F 13/1016; B01F 2005/0622; B01F 2005/0639; B01F 5/061; B01F 5/0618
See application file for complete search history.

(56) References Cited

U.S. PATENT DOCUMENTS 1,113,041 A * 10/1914 Murphy ..... F02M 1/00 48/189.4
1,637,697 A 8/1927 Jacobsen
1,648,708 A * 11/1927 Wilkinson ..... G01F 1/40 73/861.63

(Continued)

FOREIGN PATENT DOCUMENTS

DE 10361411 A1 7/2005
EP 2596854 A1 5/2013

(Continued)

OTHER PUBLICATIONS

Written Opinion of the International Searching Authority, PCT/CA2017/051153, dated Jan. 5, 2018.

(Continued)

*Primary Examiner* — Tony G Soohoo
(74) *Attorney, Agent, or Firm* — Cahn & Samuels, LLP

(57) ABSTRACT

A static mixer for mixing fluid flow in a pipeline includes a body having a plurality of slots through the body, the slots being angled with respect to an axis passing through a center of the body. A plurality of arms extends from an outer edge of the body towards a center of the body, each arm having a flat surface on a first side of the body and angled sides along at least a portion thereof extending to a second side of the body. The plurality of slots includes at least one concentric ring of slots.

18 Claims, 17 Drawing Sheets

(56) References Cited

U.S. PATENT DOCUMENTS 1,702,274 A * 2/1929 Schmidt ..... G01F 1/40 138/40
2,693,391 A 11/1954 Manseau
3,128,794 A 4/1964 Boucher et al.
3,682,443 A * 8/1972 Upmeier ..... B29C 48/362 366/336
3,863,678 A * 2/1975 Pettersson ..... B01F 5/064 138/37
3,911,073 A 10/1975 Charles-Massance
4,208,136 A 6/1980 King
4,461,579 A 7/1984 McCallum
4,495,858 A * 1/1985 Erickson ..... B01F 5/0616 454/261
4,614,440 A 9/1986 King
4,848,920 A * 7/1989 Heathe ..... B01F 5/064 366/339
4,971,450 A 11/1990 Gerich
5,605,399 A * 2/1997 King ..... B01F 5/0616 366/337
6,379,035 B1 4/2002 Kubo et al.
6,615,872 B2 * 9/2003 Goebel ..... B01F 5/064 138/37
6,878,056 B2 * 4/2005 Robinson ..... F24F 13/04 454/261
7,198,400 B2 * 4/2007 Unterlander ..... B29B 7/325 366/336
7,543,561 B2 6/2009 Shibata et al.
7,784,273 B2 * 8/2010 Kanaya ..... B01D 53/9431 60/286
7,954,514 B2 6/2011 Tung et al.
8,042,989 B2 11/2011 Gordon et al.
8,141,353 B2 * 3/2012 Zheng ..... B01F 5/0616 60/324
8,220,444 B2 7/2012 Cheung et al.
8,342,159 B2 1/2013 Detore
8,375,708 B2 * 2/2013 Forster ..... F01N 3/2892 60/324
8,495,866 B2 7/2013 Wirth
D697,942 S 1/2014 Puczok et al.
8,739,519 B2 6/2014 Hadden et al.
8,745,978 B2 6/2014 Vanvolsem et al.
8,826,649 B2 * 9/2014 Li ..... B01F 5/0618 60/295
9,010,994 B2 * 4/2015 McQueen ..... B01F 5/0616 366/337
9,016,928 B1 4/2015 England et al.
9,067,183 B2 6/2015 Glanville
9,221,022 B2 12/2015 Glanville
9,718,037 B2 * 8/2017 Harmon ..... B01F 5/0473
9,790,833 B2 * 10/2017 Kobe ..... B01F 5/0616
9,835,068 B2 * 12/2017 Mueller ..... F01N 3/206
9,975,094 B2 * 5/2018 Gillis ..... B01F 5/0485
10,288,292 B2 5/2019 Ryon
10,500,550 B2 * 12/2019 Geibel ..... B01F 5/0616
10,947,882 B2 * 3/2021 Park ..... F01N 13/10
2001/0038575 A1 * 11/2001 Mathys ..... B01F 5/0473 366/181.5
2002/0191483 A1 * 12/2002 Ohtsuki ..... B01F 5/0451 366/107
2003/0007419 A1 1/2003 Goebel et al.
2005/0039809 A1 2/2005 Speldrich et al.
2005/0099886 A1 5/2005 Grajewski et al.
2005/0219947 A1 * 10/2005 Carlson ..... B01F 5/0616 366/337
2006/0162690 A1 * 7/2006 Kim ..... F02B 31/04 123/306
2007/0205523 A1 * 9/2007 Kojima ..... B01J 19/32 261/79.2
2008/0037366 A1 2/2008 Smith
2008/0079179 A1 * 4/2008 Lundgreen ..... F24F 6/18 261/79.2
2008/0232190 A1 * 9/2008 Schneider ..... B01F 15/00935 366/337
2009/0266064 A1 * 10/2009 Zheng ..... F01N 3/2892 60/317
2009/0320453 A1 * 12/2009 Salanta ..... B01F 5/0616 60/282
2010/0084034 A1 4/2010 Sonnenberg
2010/0104705 A1 4/2010 Gordon et al.
2010/0107617 A1 * 5/2010 Kaiser ..... B01F 3/04049 60/324
2011/0174407 A1 * 7/2011 Lundberg ..... B01F 5/0616 138/37
2012/0096948 A1 4/2012 Laird et al.
2012/0297870 A1 11/2012 de Boer
2013/0176814 A1 * 7/2013 Gillis ..... B01F 5/0485 366/178.1
2013/0286769 A1 10/2013 Baron
2014/0301157 A1 10/2014 Glanville
2015/0211398 A1 7/2015 Hornback et al.
2016/0097411 A1 4/2016 Sawchuk et al.
2016/0175784 A1 6/2016 Harmon et al.
2016/0177801 A1 * 6/2016 Wohlfahrt ..... F01N 3/2892 422/168
2017/0291151 A1 * 10/2017 Berglund ..... B01F 15/063
2017/0362987 A1 * 12/2017 Fu ..... B01F 5/0618
2018/0085719 A1 * 3/2018 Larner ..... B01F 5/0618
2018/0280900 A1 * 10/2018 Tucker ..... B01F 5/0617
2018/0296993 A1 * 10/2018 Schriver ..... B01F 5/0653
2018/0306084 A1 * 10/2018 Inoue ..... F01N 3/2892
2019/0162490 A1 * 5/2019 Heusser ..... B01F 5/061
2020/0030825 A1 * 1/2020 Otoguro ..... B01F 3/04106
2020/0149687 A1 * 5/2020 Selirio ..... B01F 5/0618

FOREIGN PATENT DOCUMENTS

EP 2826547 A1 1/2015
FR 2921415 A1 3/2009
JP 2009041371 A 2/2009
WO 2016024207 A1 2/2016

OTHER PUBLICATIONS

English Abstract of DE 10361411, Jul. 28, 2005.
Westfall, Low Headloss Pipeline Mixer Model 3050, 4 pages, printed on Jul. 6, 2018.
Koflo, Static Inline Mixers, 3 pages, printed on Jul. 6, 2018.
Komax, Static Mixers—Komax Systems Inc, 1 page, printed on Jul. 6, 2018.
Statiflo, Pipe Mixers, 2 pages, printed on printed on Jul. 6, 2018.
English abstract of FR 2921415 A1, Mar. 27, 2009.
English abstract of JP 2009041371 A, Feb. 26, 2009.
Extended European Search Report, EP Application 17881461.2, dated Aug. 20, 2019.
English machine translation of FR 2921415 A1, Mar. 27, 2009.
English translation of JP 2009041371 A, Feb. 26, 2009.

* cited by examiner

FIG. 7
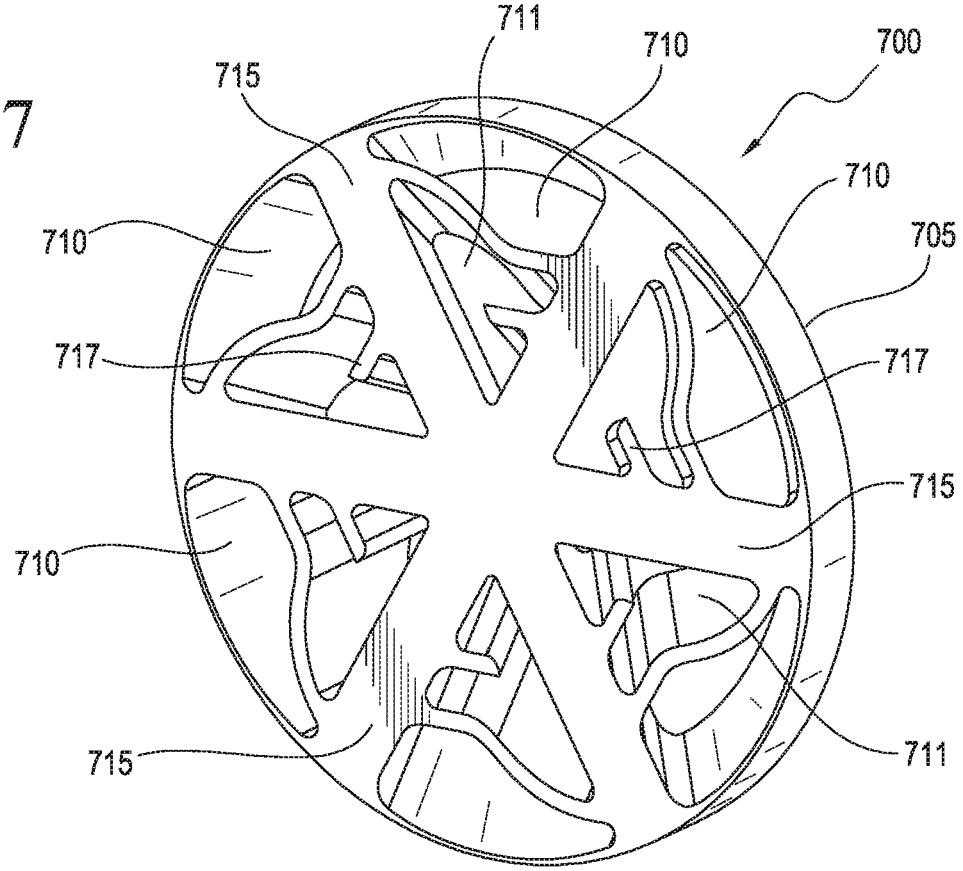
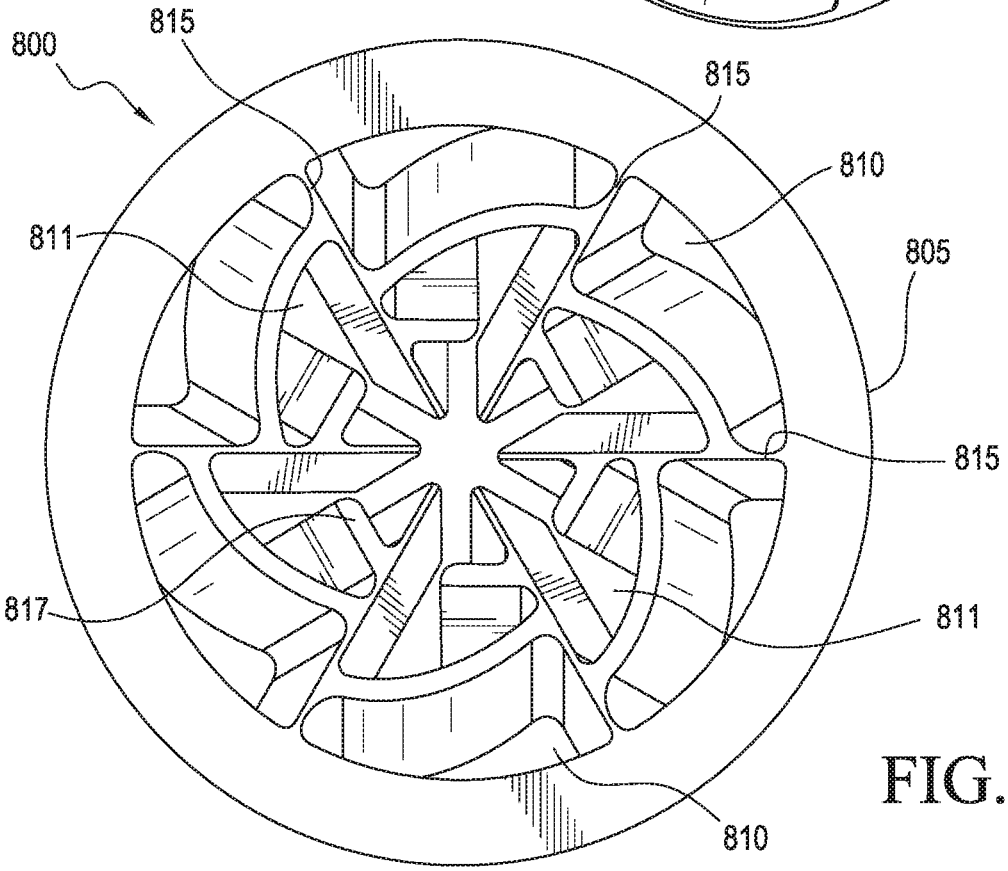
FIG. 8A

FIG. 9B
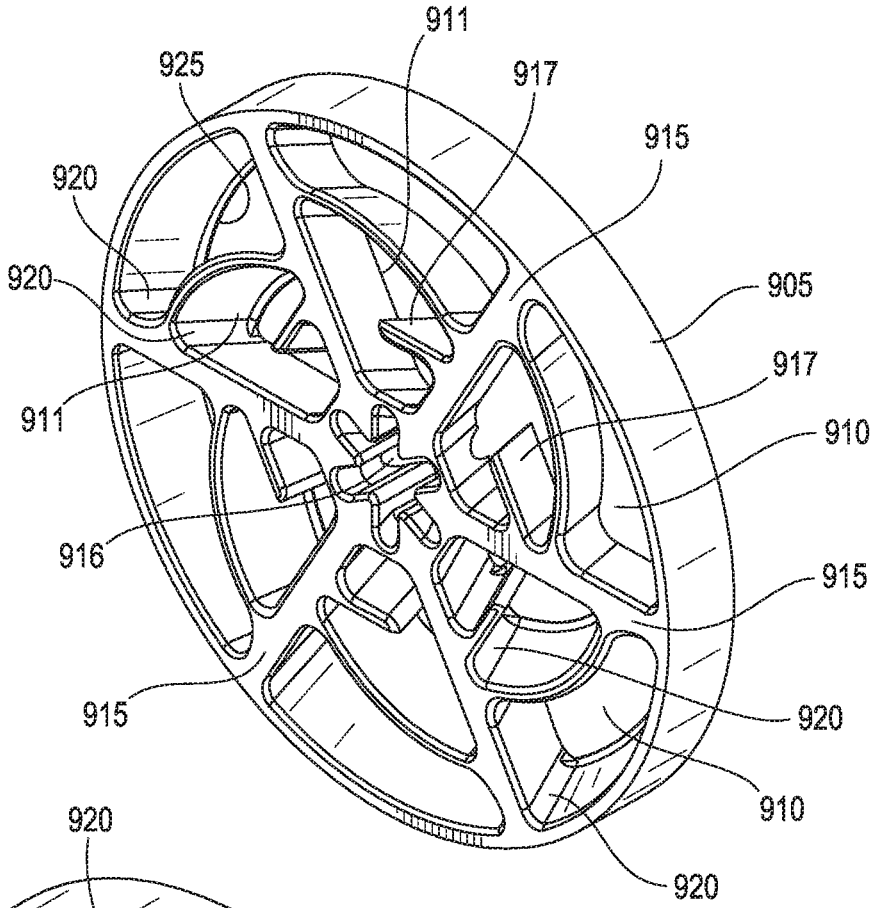
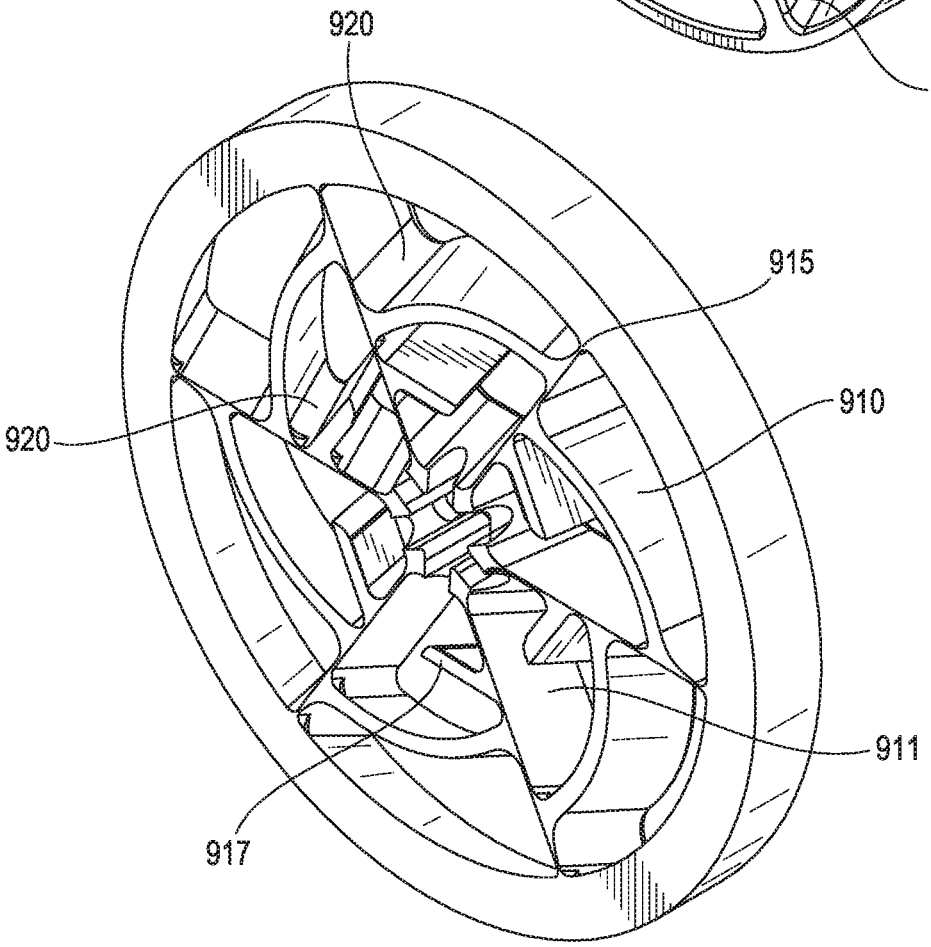
FIG. 9C

FIG. 9D
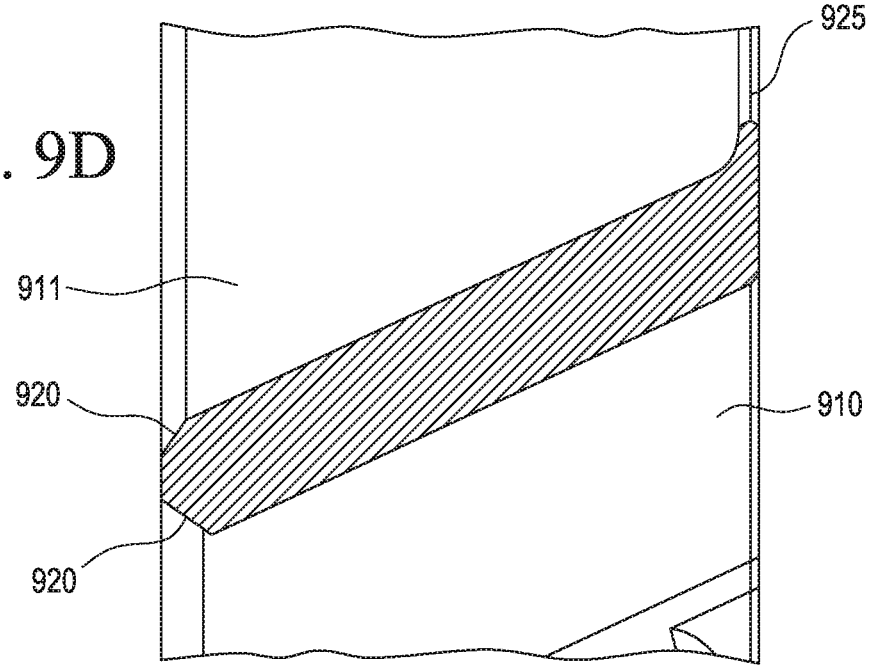
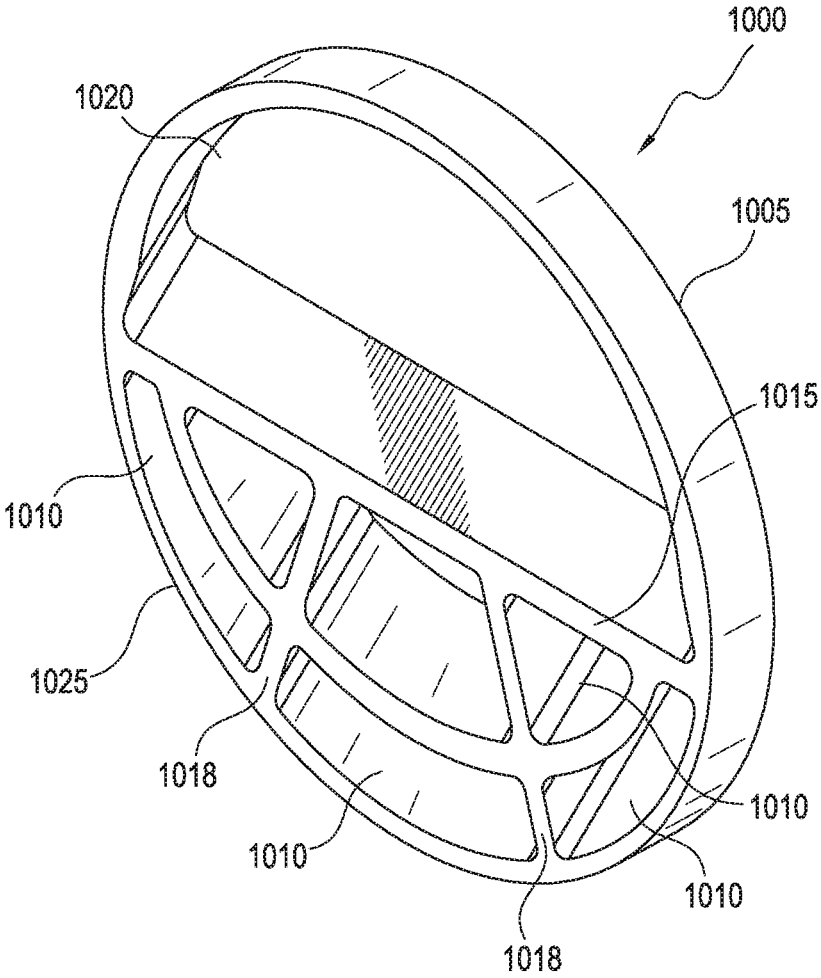
FIG. 10

STATIC MIXER FOR FLUID FLOW IN A PIPELINE

This application is a Continuation of U.S. Ser. No. 16/069,182 filed on 11 Jul. 2018, which is a U.S. national stage of PCT international application PCT/CA2017/051153 filed on 29 Sep. 2017, and claims priority to U.S. Ser. No. 62/432,732 filed on 12 Dec. 2016 and U.S. Ser. No. 62/506,668 filed on 16 May 2017 in the U.S. Patent and Trademark Office, the entireties of which are incorporated herein by reference.

I. FIELD OF INVENTION

The present invention relates to a mixing device used in pipelines, for example, in at least one of chemical, oil, gas, or water pipelines. More particularly, the present invention relates to a static mixer comprising a plurality of slots for mixing fluid flow within a pipeline and to a method for mixing fluid flow using the static mixer.

II. BACKGROUND OF THE INVENTION

Pipelines are used to transport fluids in various industries including, but not limited to, chemical, oil, gas, and manufacturing. Such industries use processes that require fluid flow parameters, such as gas composition, pressure, temperature, viscosity, and the like, to be accurately measured.

Further, pipelines often carry multiple fluids or multiple substances, for example, oil mixtures including heavy and light components. It is often necessary for multiple fluids to be mixed together so that accurate measurements may be taken.

Known static mixers, for example from KOMAX® and Statiflow, are large and can be difficult to construct and install. Static mixers from Westfall (e.g., mixer model 3050) may include vanes that require welding to a pipe wall.

III. SUMMARY OF THE INVENTION

The invention provides in a first embodiment a static mixer for mixing fluid flow in a pipeline characterized by a body having a plurality of slots through the body, the slots having one or more sides that are angled with respect to an axis passing through a center of the body; and a plurality of arms extending from an outer edge of the body towards a center of the body, each arm having a flat surface on a first side of the body and angled sides along at least a portion thereof extending to a second side of the body. The plurality of slots includes at least one concentric ring of slots.

The invention provides in a second embodiment further to any of the previous embodiments a static mixer characterized in that the body comprises a circular or ring structure.

The invention provides in a third embodiment further to any of the previous embodiments a static mixer characterized in that the plurality of slots includes at least two concentric rings of slots.

The invention provides in a fourth embodiment further to any of the previous embodiments a static mixer characterized in that each slot has at least one side that is straight, curved, or wavy.

The invention provides in a fifth embodiment further to any of the previous embodiments a static mixer characterized in that a first set of a plurality of slots are oriented at a different angle than a second set of a plurality of slots.

The invention provides in a sixth embodiment further to any of the previous embodiments a static mixer characterized in that each slot has an angle from about 20-45° relative to the axis through a center of the body.

The invention provides in a seventh embodiment further to any of the previous embodiments a static mixer characterized in that the plurality of arms comprise 4 to 8 arms.

The invention provides in an eighth embodiment further to any of the previous embodiments a static mixer characterized in that one or more slots comprise at least one chamfer extending from a first side of the body to a second side of the body.

The invention provides in a ninth embodiment further to any of the previous embodiments a static mixer characterized in that one or more slots comprise at least one lip or flap that extends or curves inwardly from a side of the body.

The invention provides a first pipe assembly embodiment characterized by a fluid flow pipeline and at least one static mixer according to any of the previous embodiments disposed in the fluid flow pipeline in an orientation substantially perpendicular to a longitudinal axis of the fluid flow pipeline.

The invention provides in a second pipe assembly embodiment further to any of the previous pipe assembly embodiments a pre-mixer upstream of the at least one static mixer.

The invention provides a in a third pipe assembly embodiment further to any of the previous pipe assembly embodiments further characterized by two or more static mixers.

The invention provides a first method embodiment characterized by mixing a fluid within a fluid flow pipeline with at least one static mixer according to any of the previous static mixer embodiments.

The invention provides a second method embodiment further to any of the previous method embodiments characterized in that the fluid comprises two or more fluids.

The invention provides a third method embodiment further to any of the previous method embodiments characterized in that the fluid comprises a gas.

The invention provides a fourth method embodiment further to any of the previous method embodiments further characterized by pre-mixing the fluid with a pre-mixer upstream of the at least one static mixer.

The invention provides a first pre-mixer embodiment for mixing fluid flow in a pipeline characterized by a body having a ring structure and comprising at least one first arm that extends a diameter of the ring structure, a plurality of second arms extending from the ring structure to the at least one first arm, thereby forming a plurality of slots, each slot being angled with respect to an axis passing through a center of the body.

The invention provides a second pre-mixer embodiment further to any of the previous pre-mixer embodiments characterized in that the at least one first arm comprises two first arms that extend a diameter of the ring structure and further characterized by one or more second arms extending between the two first arms and one or more second arms extending between the at least one first arm and the ring structure, thereby forming a plurality of slots.

The invention provides a third pre-mixer embodiment further to any of the previous pre-mixer embodiments characterized in that one or more sides of the plurality of slots is straight, wavy, or a curved.

The invention provides a fourth pre-mixer embodiment further to any of the previous pre-mixer embodiments characterized in that one or more slots comprise a chamfer extending from a first side of the body to a second side of the body.

The invention provides a fifth pre-mixer embodiment further to any of the previous pre-mixer embodiments characterized in that one or more slots comprise a lip or flap that extends or curves inwardly from a side of the body.

The invention provides a sixth pre-mixer embodiment further to any of the previous pre-mixer embodiments characterize in that a first set of a plurality of slots are oriented at a different angle that a second set of a plurality of slots.

It is an object of the present invention to ensure proper mixing of fluid flow within a fluid flow pipeline and therefore to achieve proper performance of a sampling system.

An advantage of the mixer of the present invention is that the static mixer installs easily within a fluid flow pipeline.

Another advantage of the mixer of the present invention is that it takes up less space within a pipeline than known mixers.

As used herein "substantially", "relatively", "generally", "about", and "approximately" are relative modifiers intended to indicate permissible variation from the characteristic so modified (e.g., ±0.1%, ±0.5%, ±1.0%, ±2%, ±5%, ±10%, ±20%). They are not intended to be limited to the absolute value or characteristic which it modifies but rather approaching or approximating such a physical or functional characteristic.

In the detailed description, references to "one embodiment", "an embodiment", or "in embodiments" mean that the feature being referred to is included in at least one embodiment of the invention. Moreover, separate references to "one embodiment", "an embodiment", or "in embodiments" do not necessarily refer to the same embodiment; however, neither are such embodiments mutually exclusive, unless so stated, and except as will be apparent to those skilled in the art. Thus, the invention can include any variety of combinations and/or integrations of the embodiments described herein.

Given the following enabling description of the drawings, the devices, assemblies, and methods should become evident to a person of ordinary skill in the art.

IV. BRIEF DESCRIPTION OF THE DRAWINGS

FIG. 7 illustrates a perspective view of a mixer according to a seventh embodiment of the present invention.

FIG. 8A illustrates a rear view of a mixer according to an eighth embodiment of the present invention.

Figure 9A:
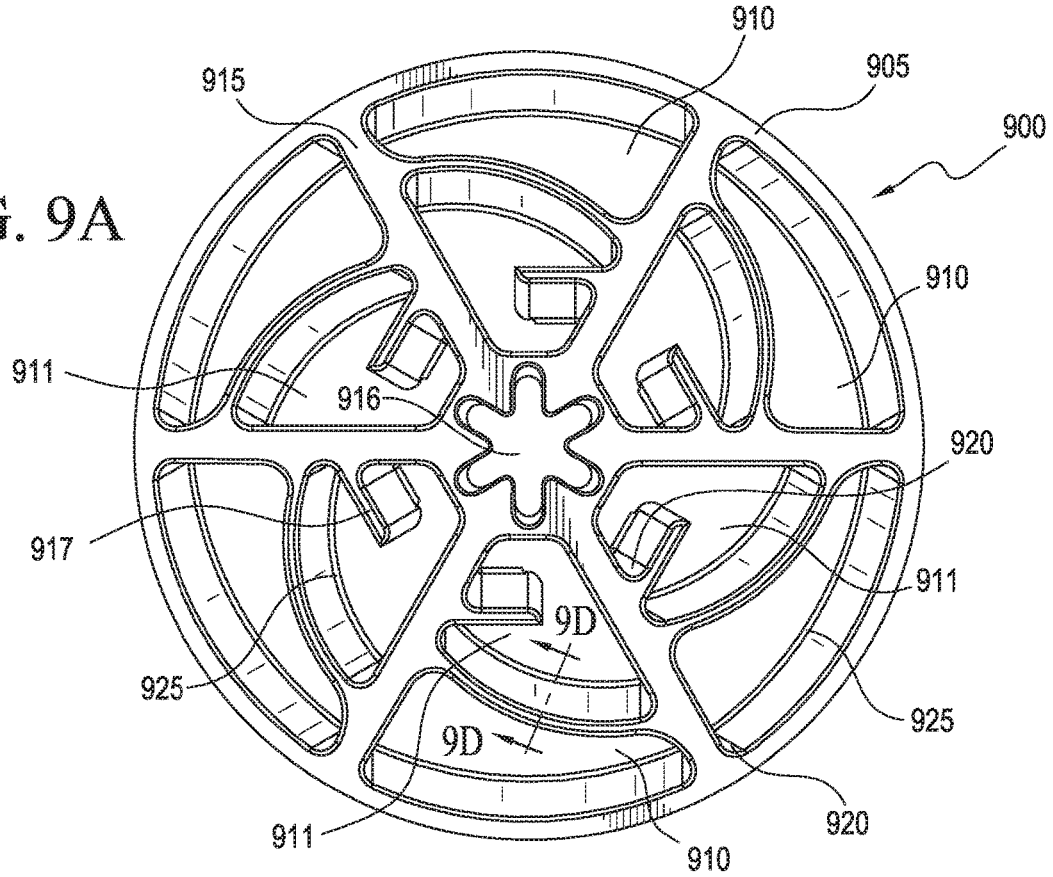

FIG. 9A illustrates a front view of a mixer according to a ninth embodiment of the present invention. FIG. 9B illustrates a front perspective view and FIG. 9C illustrates a rear perspective view of the mixer of FIG. 9A. FIG. 9D illustrates a cross-section view of the mixer of FIG. 9A.

FIG. 10 illustrates a perspective view of a first embodiment of a pre-mixer according to the present invention.

Figure 11:
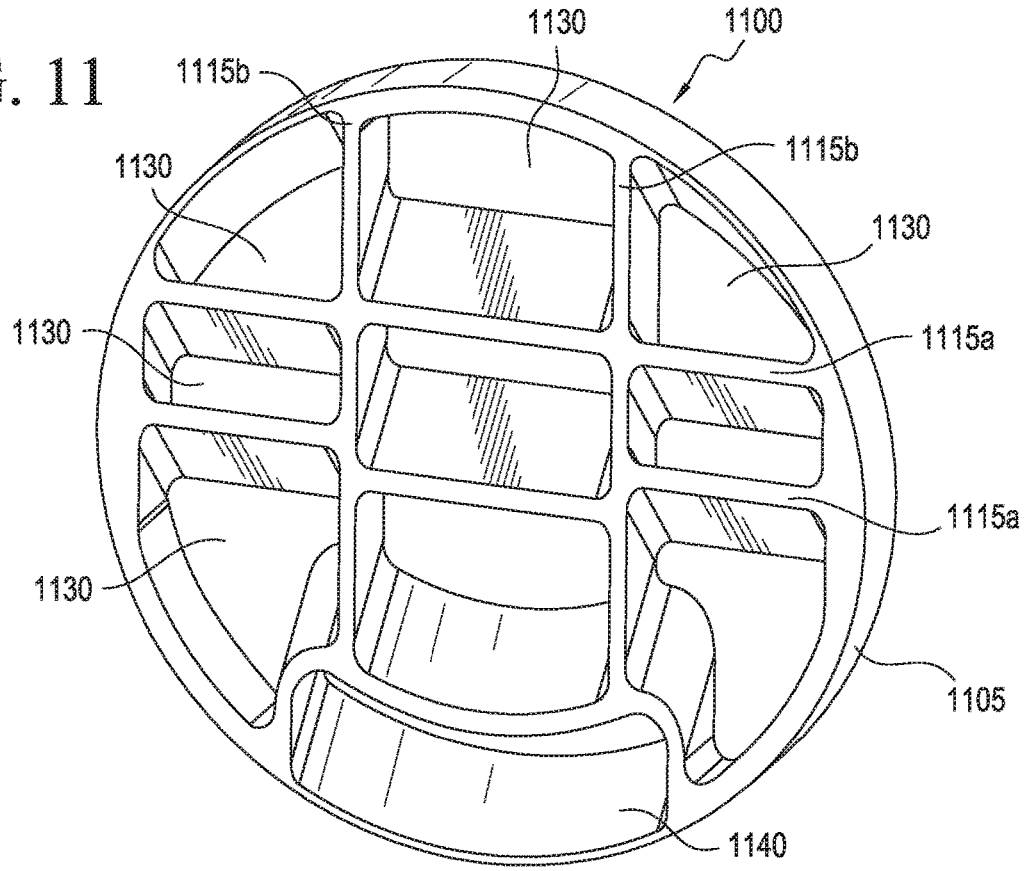

FIG. 11 illustrates a front view of a second embodiment of a pre-mixer according to the present invention.

Figure 12A:
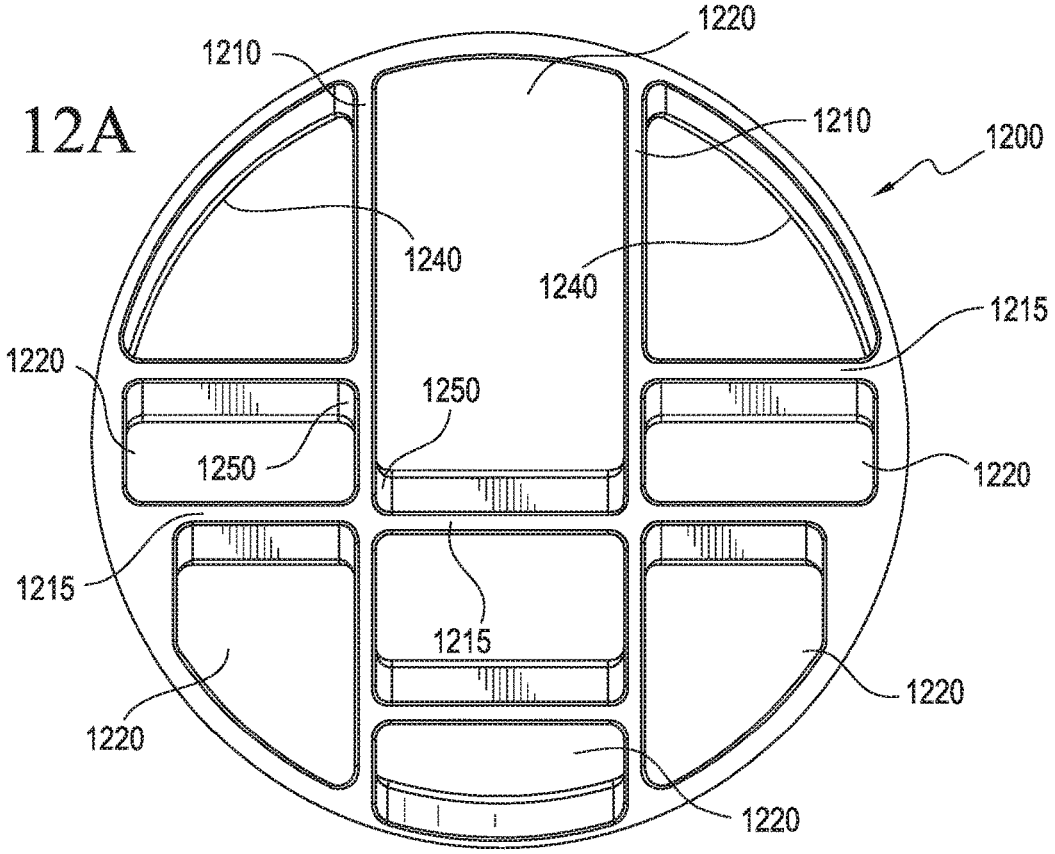
Figure 12B:
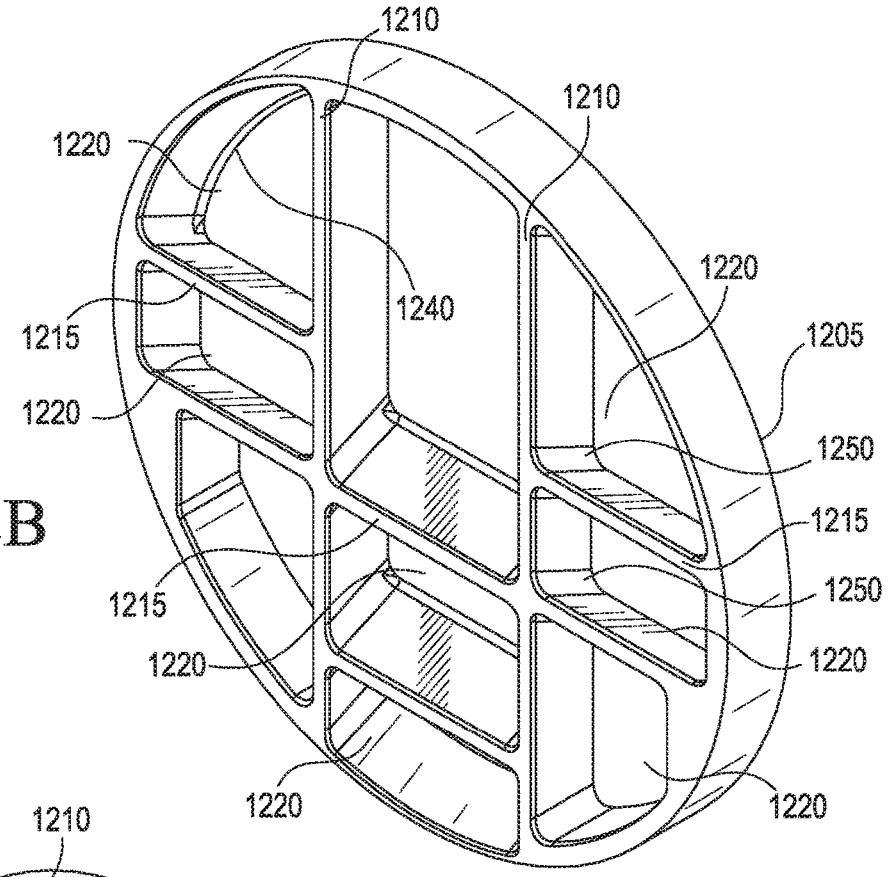
Figure 12C:
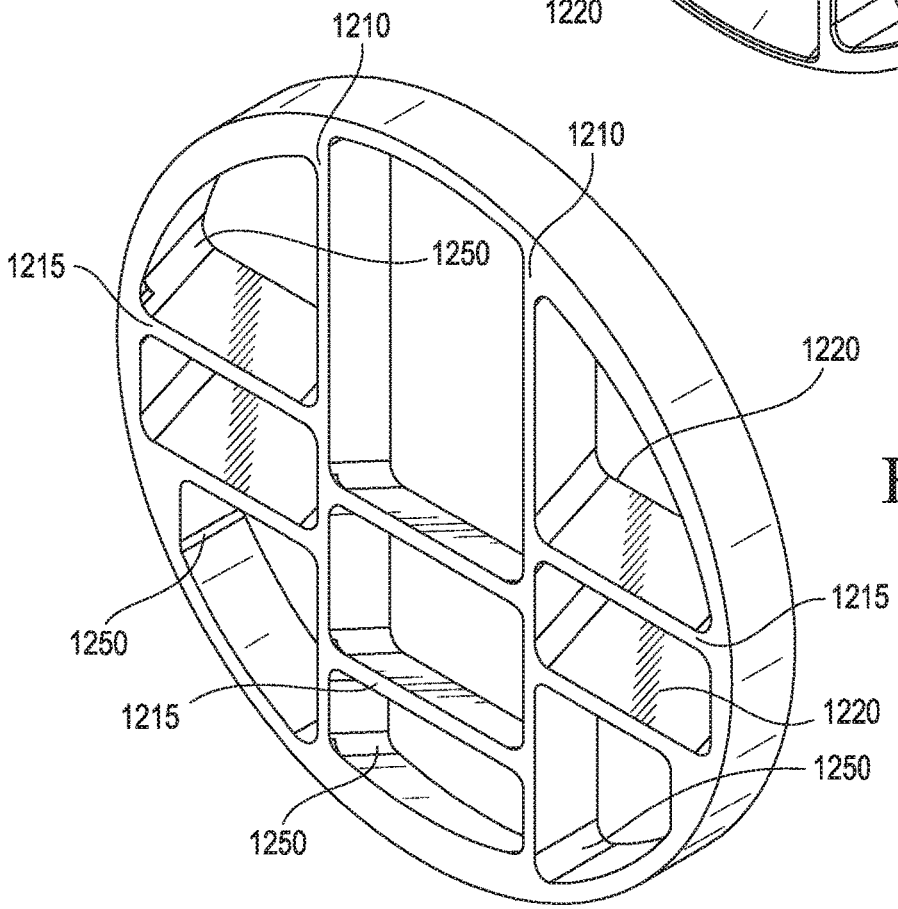

FIG. 12A illustrates a front view of a third embodiment of a pre-mixer according to the present invention. FIG. 12B illustrates a front perspective view and FIG. 12C illustrates a rear perspective view of the pre-mixer of FIG. 12A.

Figure 13:
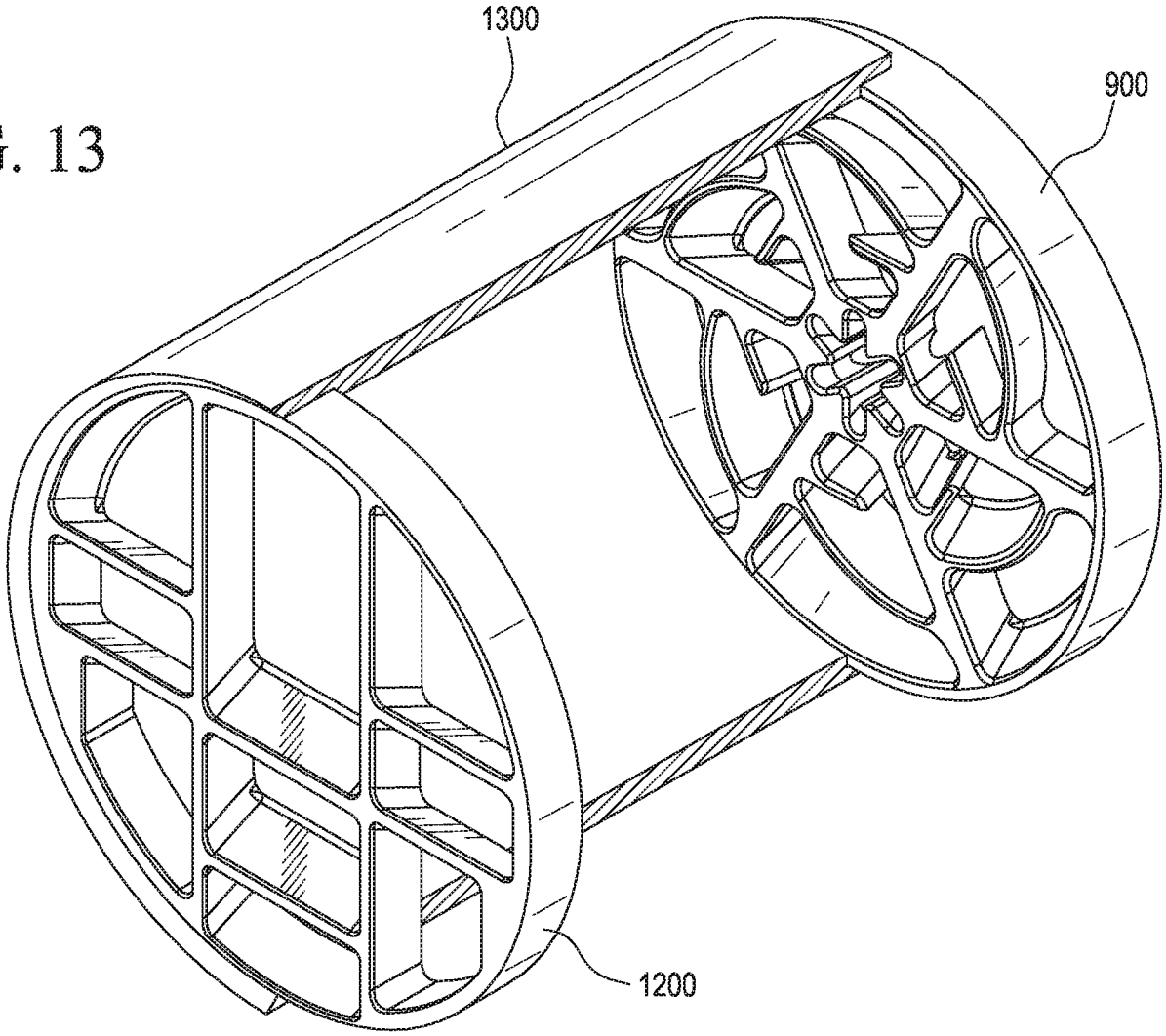

FIG. 13 illustrates a schematic view of a sleeve (cut-away view) including the mixer of FIG. 9A and the pre-mixer of FIG. 12A to be installed in a fluid flow pipe according to one embodiment of the present invention.

Figure 14:
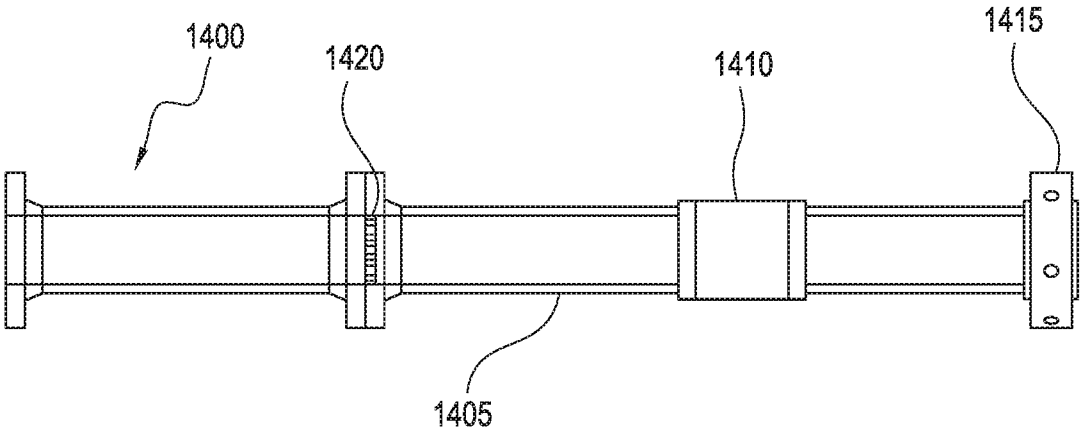

FIG. 14 illustrates a schematic view of a pipe assembly including a fluid flow pipe with a mixer according to the present invention.

Given the following enabling description of the drawings, the methods and systems should become evident to a person of ordinary skill in the art.

V. DETAILED DESCRIPTION OF THE INVENTION

A static mixer according to the present invention may be utilized for mixing fluid flow, for example, in at least one of chemical, oil, gas, or water pipelines. The static mixer may be made according to typical manufacturing methods including, but not limited to, welding, threading, fit interference, or using fasteners such as bolts, screws, adhesives, or the like. In a specific embodiment, the entire static mixer may be machined out of the same material to provide a unitary, integral structure.

According to the present invention, the static mixer comprises a body or disk having a plurality of slots or cutouts for mixing fluid flow within a pipeline. The body or disk comprising the plurality of slots may be in the form of a circular or ring structure.

The slots may be of any desired shape, having one or more sides that are straight, curved, wavy, or a combination thereof. In a specific embodiment, the plurality of slots may comprise a series of slots in close proximity to one another, thereby forming an array or cascade. For example, the plurality of slots may comprise 1 to 4 concentric rings of slots. The slots or cutouts are sometimes referred to as vanes.

According to the present invention, each slot is angled with respect to an axis passing through a center of the body (i.e., a longitudinal axis of a pipeline in which the static mixer is installed). The slots may have one or more sides that are angled at 20-50°, for example 25-45°, with respect to an axis passing through a center of the body. The slots in the body may be oriented at the same angle or may be oriented at differing angles from one another.

The static mixer includes a plurality of arms extending from an outer edge of the body towards a center of the body. The arms may connect with each other in a center of the body or, in specific embodiments, there may be a hole in the central region of the body.

In specific embodiments, one or more arms may have a flat or blunt surface on a first side (e.g., front or upstream side) of the body and angled sides extending along at least a portion thereof towards a second side (e.g., rear or downstream side) of the body. Thus, in specific embodiments, one or more arms may be in the form of a triangular wedge. The angled sides may form a part or a side of an inner concentric ring of slots and/or an outer concentric ring of slots. In embodiments, a static mixer may have from 4 to 8 arms. In specific embodiments, each slot may be located between two arms.

The static mixer may be scaled in size in relation to a fluid flow pipeline in which it is to be installed. In embodiments, the static mixer may have a thickness of less than 10-20% of the inner pipe diameter (D) in which the mixer is installed, for example 12-15% D. Thus, in embodiments when an inner pipe diameter is from 2 to 20 inches (5.1 to 51 cm), the thickness of the static mixer may be about 0.24 to 3 inches (0.6 to 7.62 cm).

The static mixer may be installed within a pipeline carrying a fluid flow. The static mixer may be installed at an orientation that is substantially perpendicular to a longitudinal axis of the pipeline. As fluid flow passes through the static mixer, the slots impart rotating and turbulent flow to the fluid(s), thereby encouraging mixing of the fluid(s). The static mixer causes the fluid composition in a center of the pipeline to become an accurate representative sample of the fluid in the pipeline as a whole. In specific embodiments, a fluid flow pipeline may carry two or more fluids, for example, light and heavy gas fluids.

The present invention is also directed to a pre-mixer for mixing fluid flow in a pipeline. The pre-mixer may comprise a body having a circular or ring structure. At least one first arm extends a diameter of the ring structure. A plurality of second arms extends from the ring structure to the at least one first arm, thereby forming a plurality of slots. According to the present invention, each slot is angled with respect to an axis passing through a center of the body (i.e., a longitudinal axis of a pipeline in which the pre-mixer is installed).

A pre-mixer may be used in conjunction with any other mixer, for example, any of the static mixers according to the present invention. In a particular embodiment, a pre-mixer may be installed upstream of a static mixer. Alternatively, the pre-mixer may be used itself for mixing fluid flow in a pipeline. Due to its configuration, the pre-mixer may be useful in mixing fluids in which material has settled towards a bottom of a fluid flow pipeline, thereby diverting such settled matter in an upward direction.

Figure 1A:
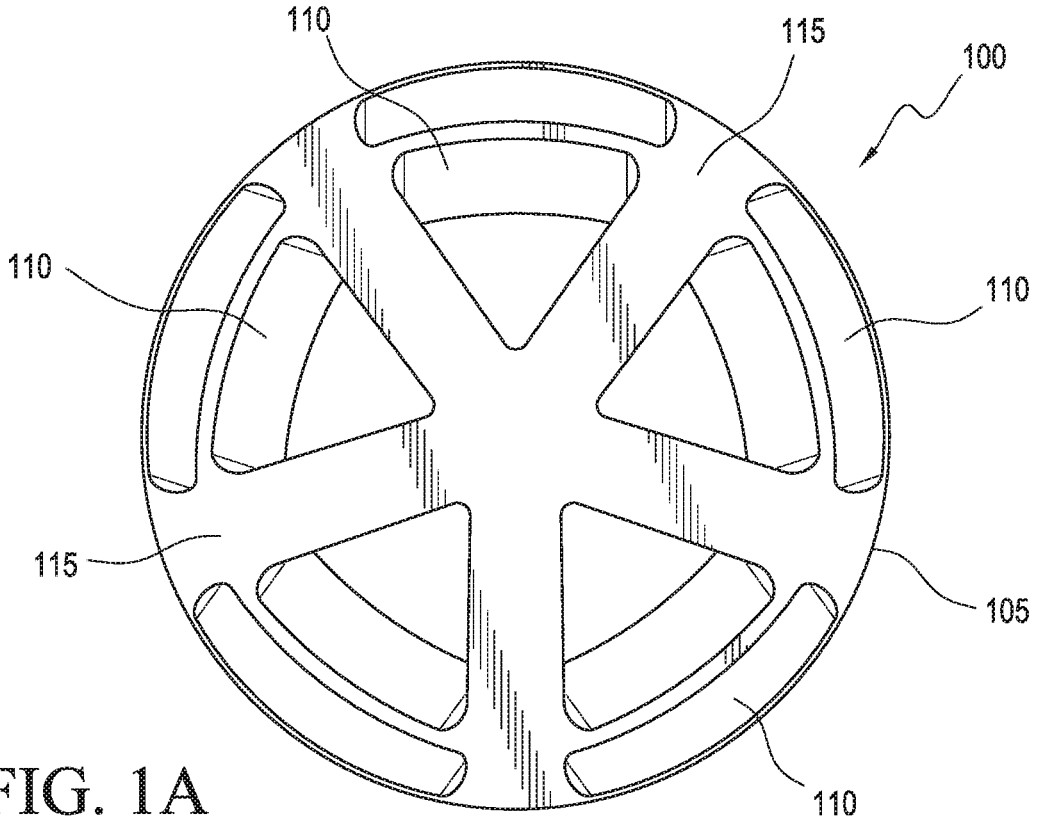
FIG. 1A illustrates a front view of a mixer according to a first embodiment of the present invention.
Figure 1B:
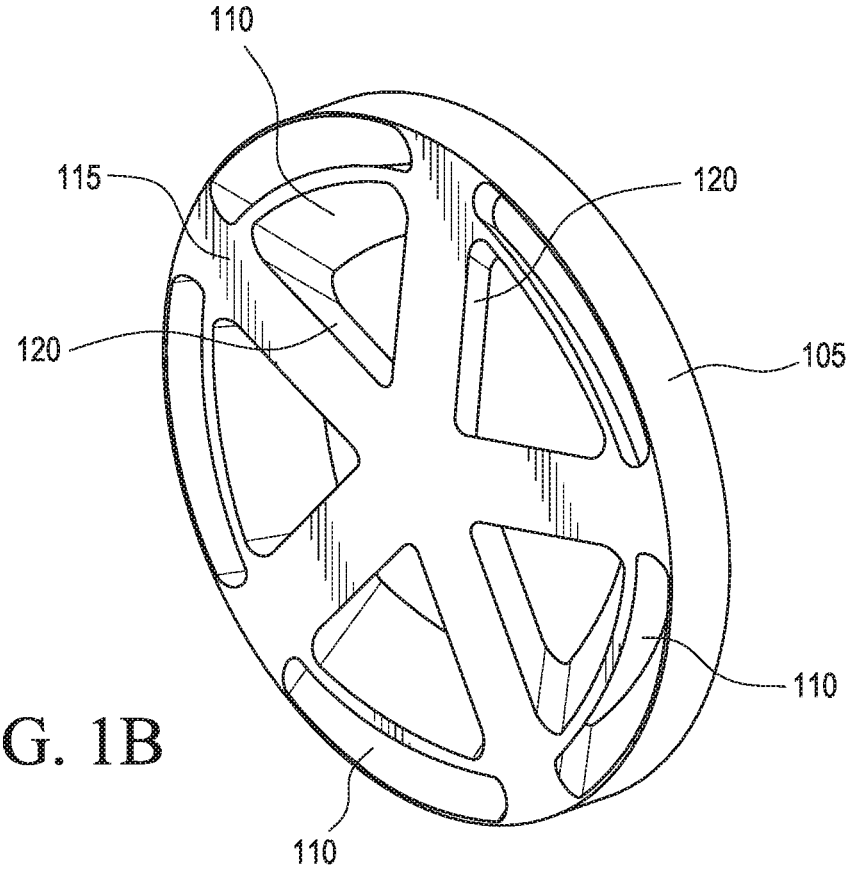
FIG. 1B illustrates a perspective view and FIG. 1C illustrates a rear view of the mixer of FIG. 1A.
Figure 1C:
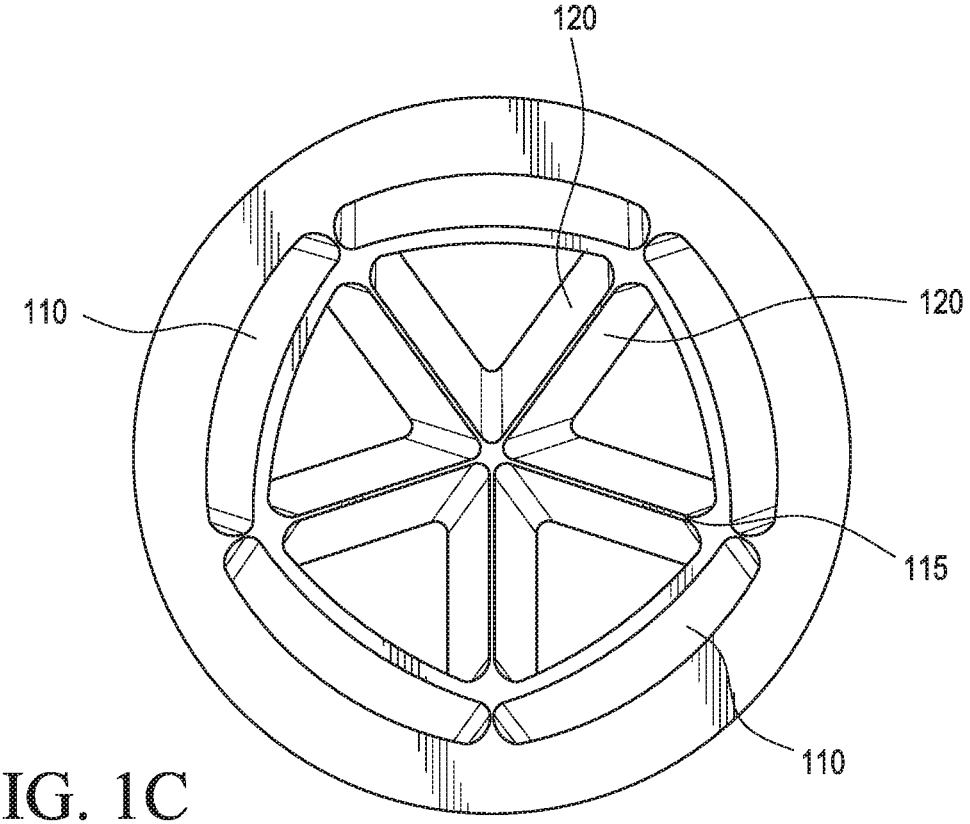

FIG. 1A illustrates a front view of a mixer 100 for mixing fluid flow according to one embodiment of the present invention. The mixer comprises a body 105 having a circular or ring structure. The body comprises a plurality of slots 110, each slot being angled with respect to an axis passing through a center of the body. The slots 110 comprise an inner concentric ring of slots and an outer concentric ring of slots. A plurality of arms 115 extend from an outer edge or side of the body towards and connect at a center of the body (in a central region). Each of the plurality of arms 115 has a flat surface on a first side of the body 105 and angled sides 120 extending along at least a portion thereof to a second side of the body 105 (FIGS. 1B-1C). The angled sides 120 form sides or part of the inner concentric ring of slots. The respective slots 110 are located between two arms 115 on at least a first side of the body. FIG. 1B illustrates a perspective view of the mixer of FIG. 1A. FIG. 1C illustrates a rear view of the mixer of FIG. 1A.

Figure 2A:
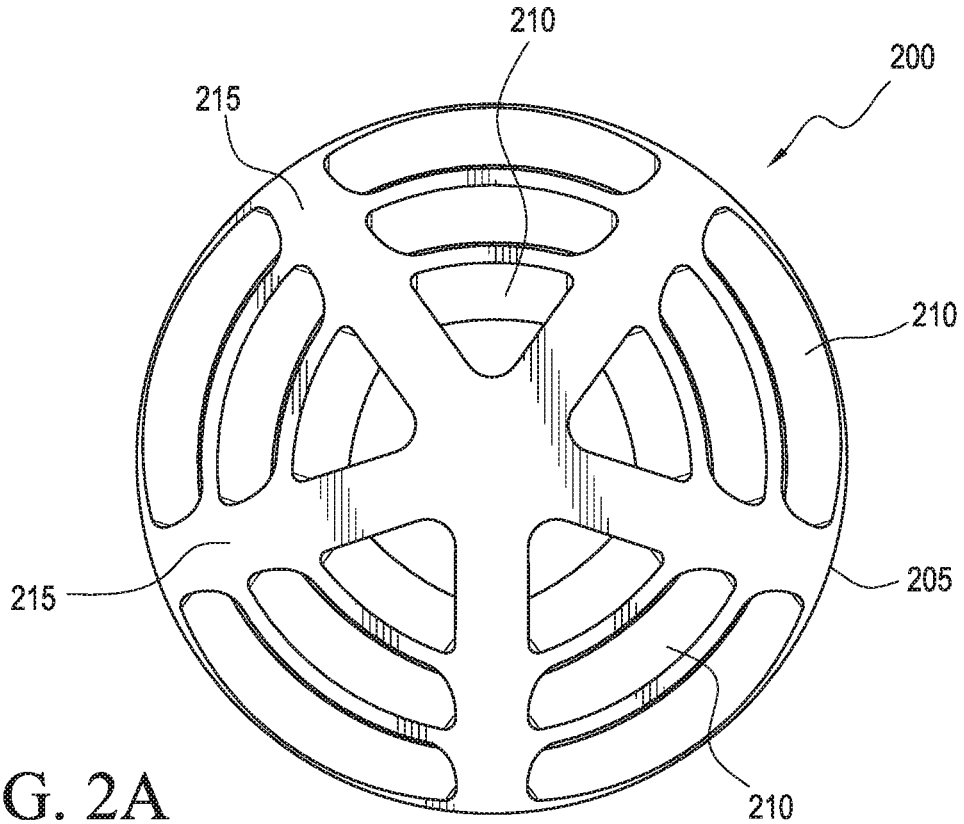
FIG. 2A illustrates a front view of a mixer according to a second embodiment of the present invention.
Figure 2B:
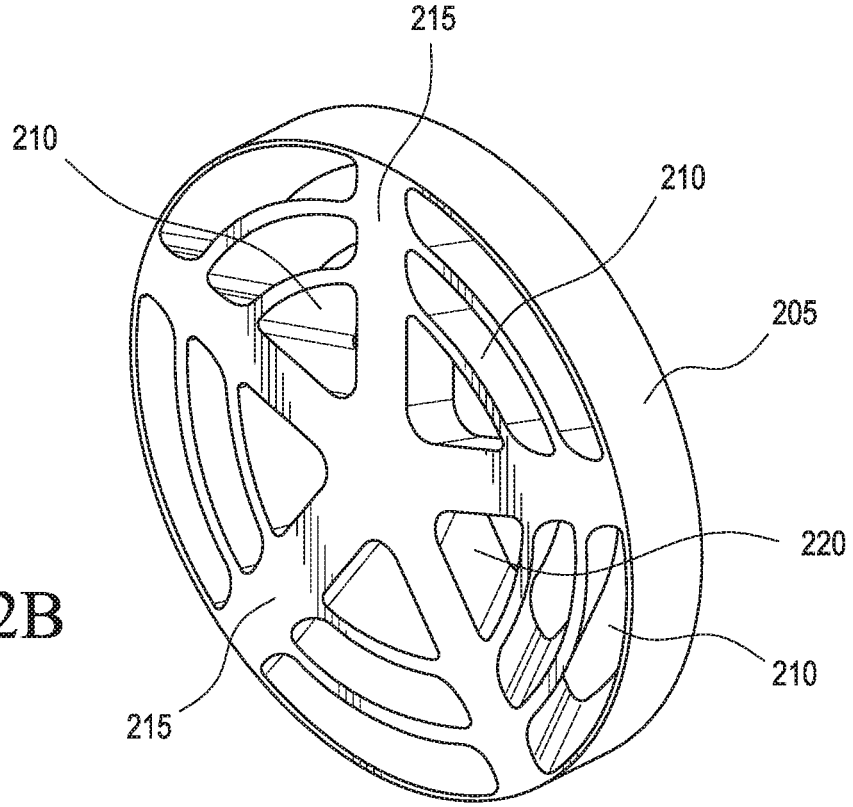
FIG. 2B illustrates a perspective view and FIG. 2C illustrates a rear view of the mixer of FIG. 2A.
Figure 2C:
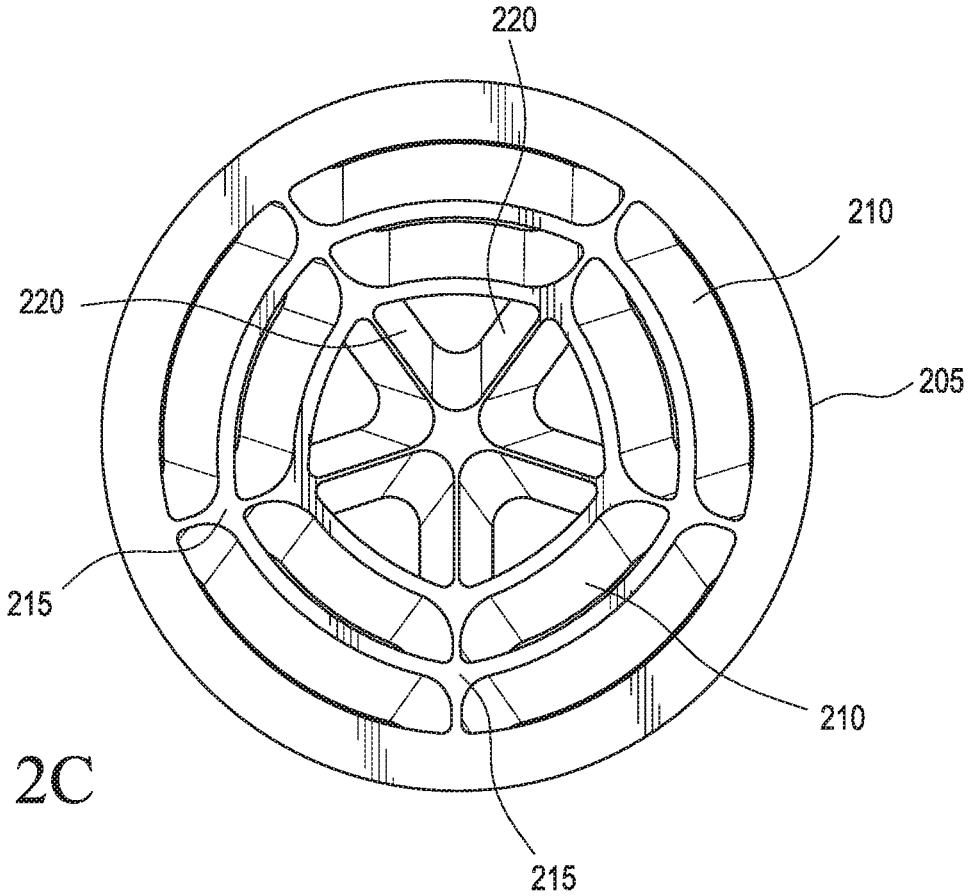

FIG. 2A illustrates a front view of mixer 200 according to a second embodiment of the present invention. The mixer comprises a body 205 having a circular or ring structure. The body comprises a plurality of slots 210 forming three concentric rings of slots in the form of an array or cascade. Each slot 210 is angled with respect to an axis passing through a center of the body. A plurality of arms 215 extend from an outer edge or side of the body towards and connect at a center of the body. Each of the plurality of arms 215 has a flat surface on a first side of the body 205 and angled sides 220 extending along at least a portion thereof to a second side of the body 205 (FIGS. 2B-2C). The angled sides 220 form sides or part of the inner concentric ring of slots. The respective slots 210 are located between two arms 215 on at least a first side of the body. FIG. 2B illustrates a perspective view of the mixer of FIG. 2A. FIG. 2C illustrates a rear view of the mixer of FIG. 2A.

Figure 3A:
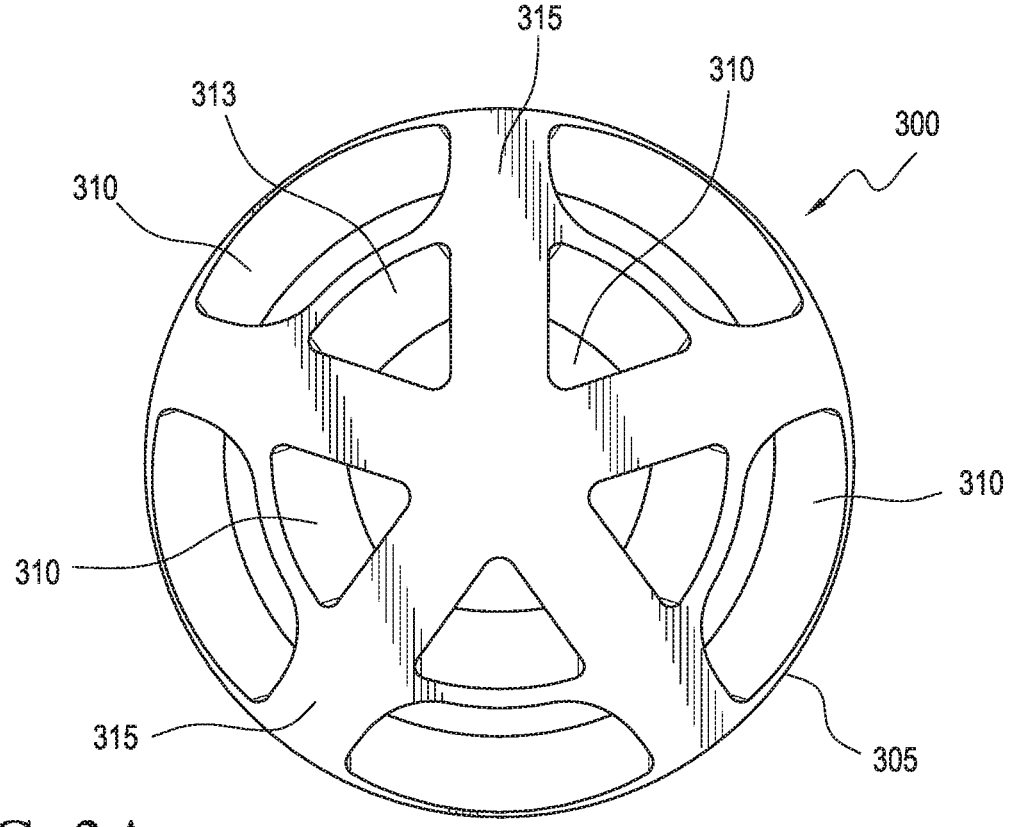
FIG. 3A illustrates a front view of a mixer according to a third embodiment of the present invention.
Figure 3B:
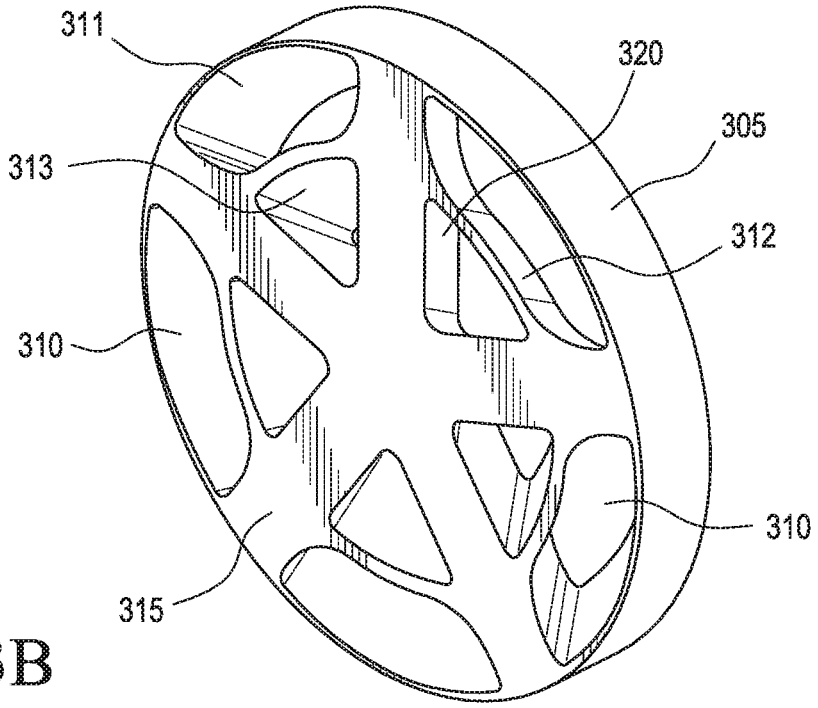
FIG. 3B illustrates a perspective view and FIG. 3C illustrates a rear view of the mixer of FIG. 3A.
Figure 3C:
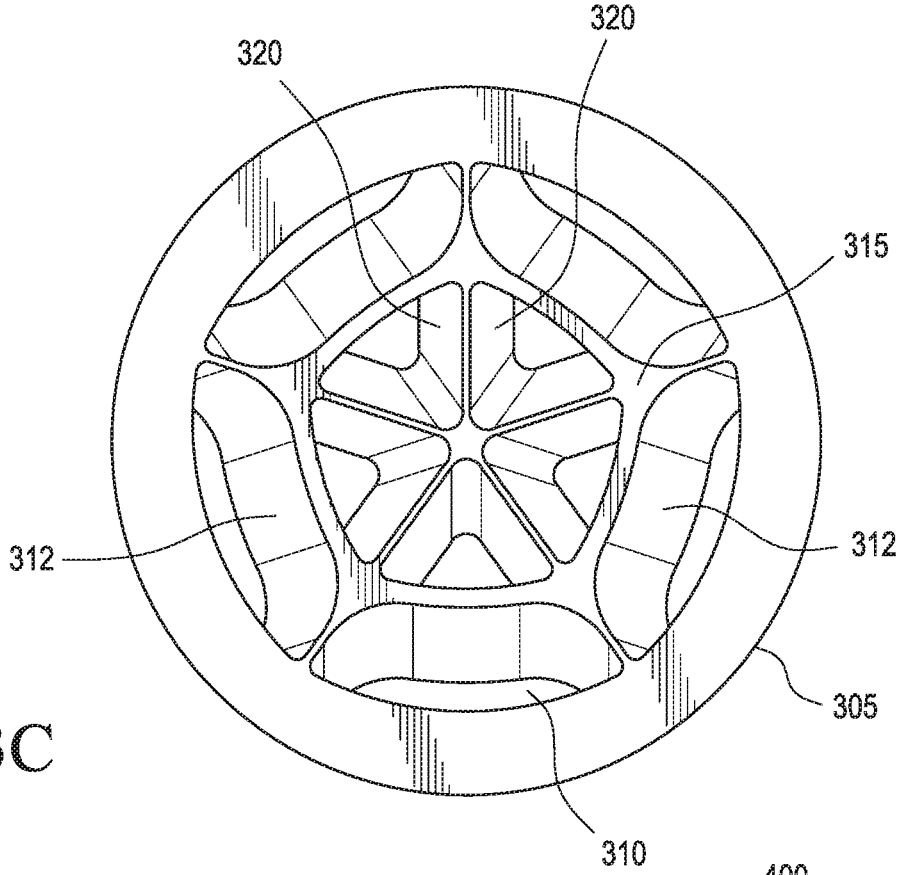

FIG. 3A illustrates a front view of a mixer 300 according to a third embodiment of the present invention. The mixer comprises a body 305 having a circular or ring structure. The body comprises a plurality of slots 310 comprising an inner concentric ring of slots and an outer concentric ring of slots. The slots 310 are angled with respect to an axis through a center of the body. Slots 310 forming the outer concentric circle have a first curved side 311 and a second wavy side 312 (FIGS. 3B-3C); inner slots 310 have a curved side 313. A plurality of arms 315 extend from an outer edge or side of the body towards and connect at a center of the body. Each of the plurality of arms 315 has a flat surface on a first side of the body and angled sides 320 along at least a portion thereof extending to a second side of the body (FIG. 3C). The angled sides 320 form sides or part of the inner concentric ring of slots. Respective slots 310 are located between two arms 315 on at least a first side of the body. FIG. 3B illustrates a perspective view of the mixer of FIG. 3A. FIG. 3C illustrates a rear view of the mixer of FIG. 3A.

Figure 4A:
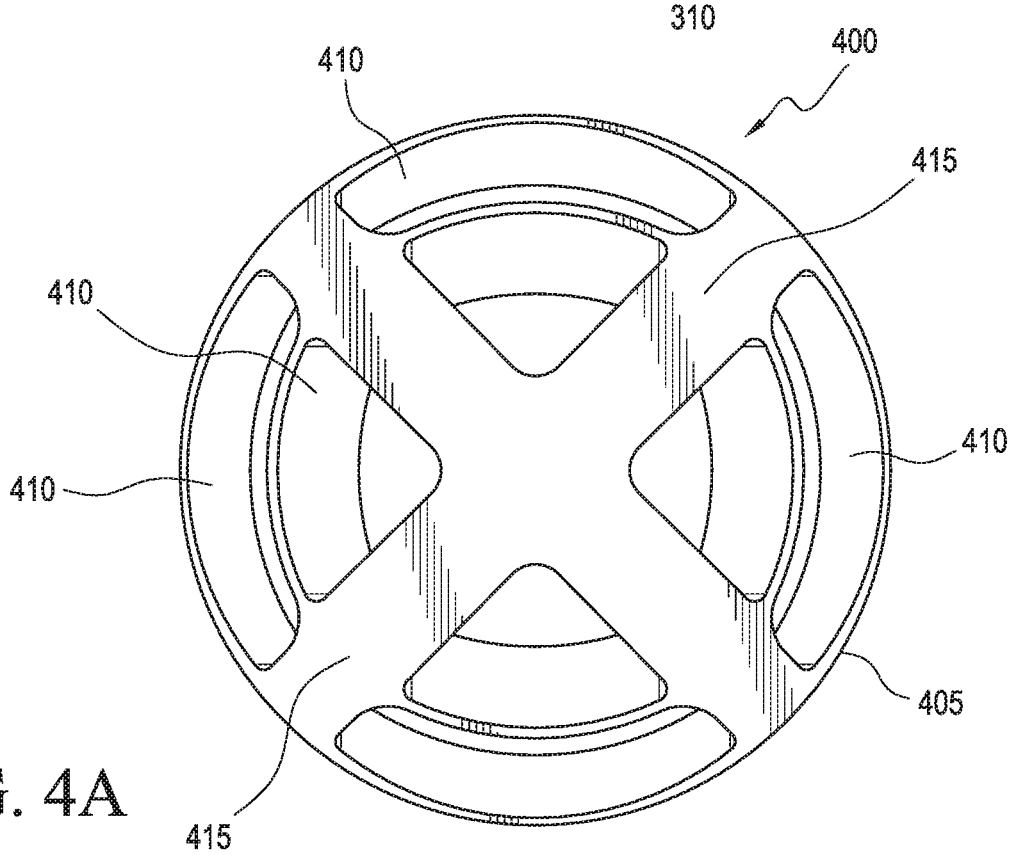
FIG. 4A illustrates a front view of a mixer according to a fourth embodiment of the present invention.
Figure 4B:
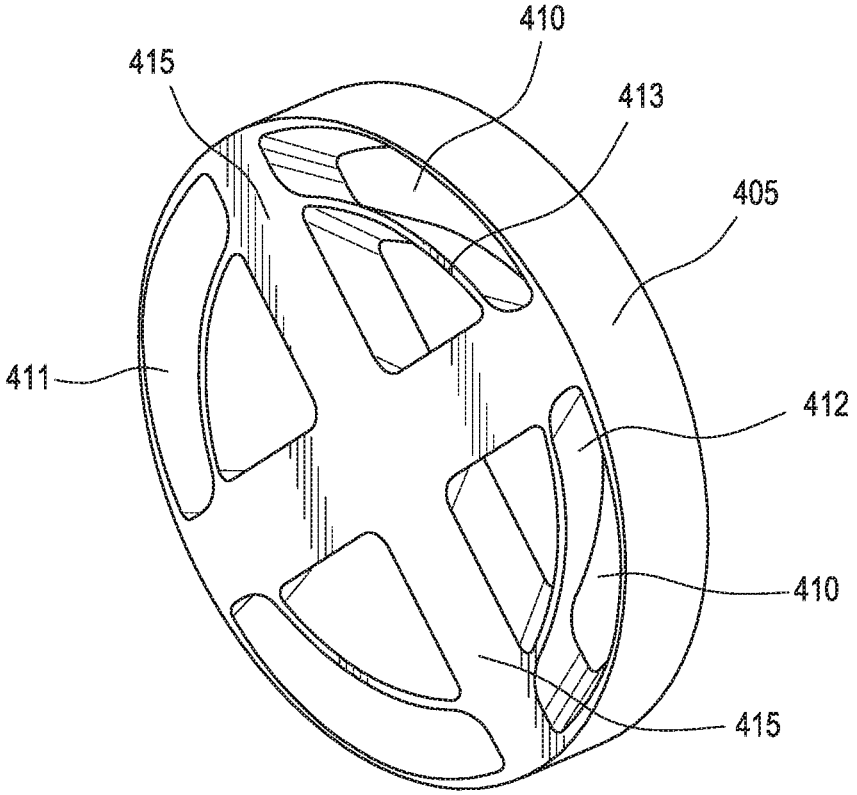
FIG. 4B illustrates a perspective view and FIG. 4C illustrates a rear view of the mixer of FIG. 4A.
Figure 4C:
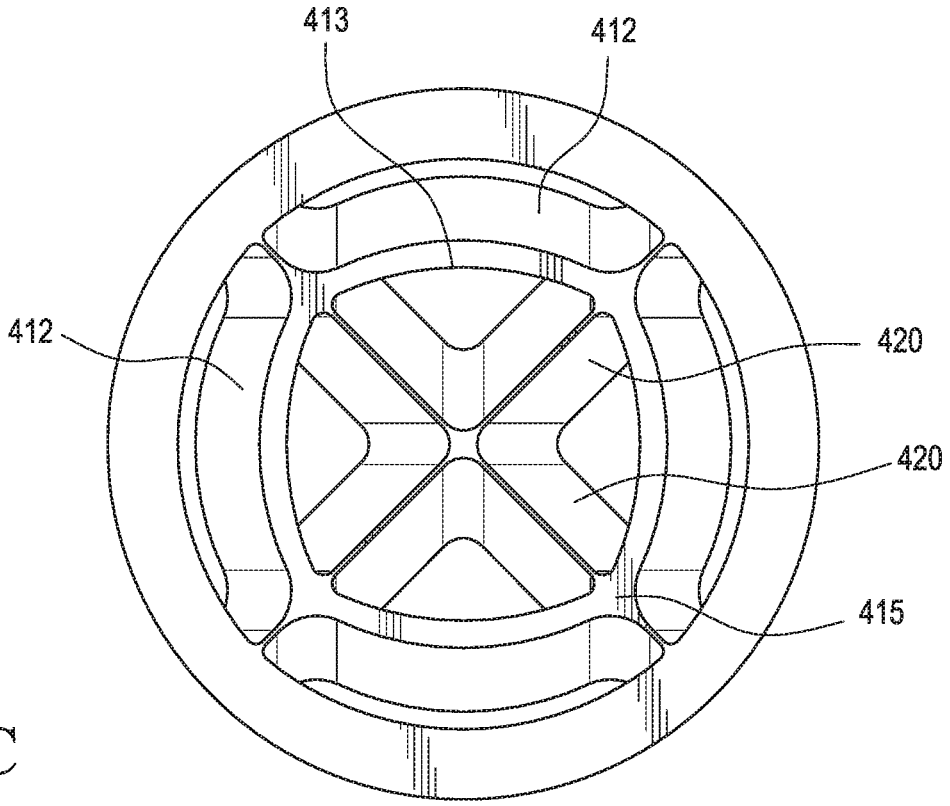

FIG. 4A illustrates a front view of a first side of a mixer 400 according to a fourth embodiment of the present invention. The mixer comprises a body 405 having a circular or ring structure. The body comprises a plurality of slots 410 forming an inner concentric ring of slots and an outer concentric ring of slots. The slots are angled with respect to an axis through a center of the body. Slots 410 forming the outer concentric circle have a first curved side 411 and a second wavy side 412 (FIGS. 4B-4C); the inner concentric ring of slots 410 have a curved side 413. A plurality of arms 415 extend from an outer edge or side of the body towards and connect at a center of the body. Each of the plurality of arms 415 has a flat surface on a first side of the body 405 and angled sides 420 along at least a portion thereof extending to a second side of the body (FIG. 4C). The angled sides 420 form sides or part of the inner concentric ring of slots. Respective slots 410 are located between two arms 415 on at least a first side of the body. FIG. 4B illustrates a perspective view of the mixer of FIG. 4A. FIG. 4C illustrates a rear view of the mixer of FIG. 4A.

Figure 5A:
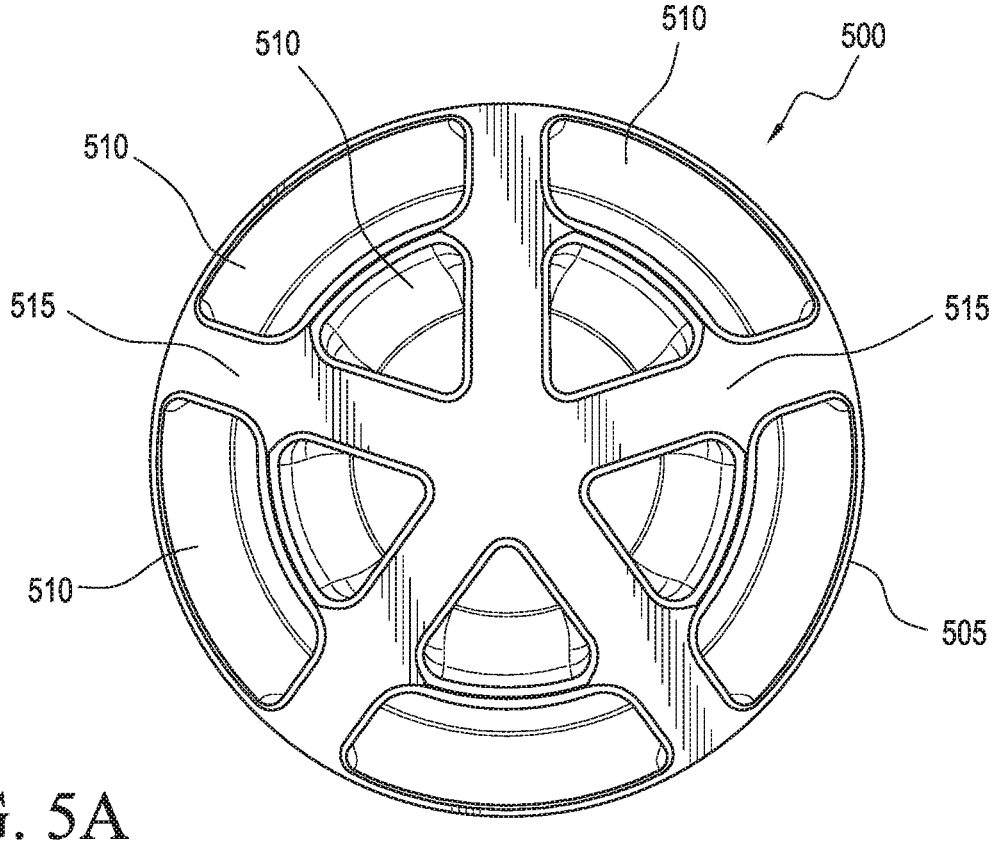
FIG. 5A illustrates a front view of a mixer according to a fifth embodiment of the present invention.
Figure 5B:
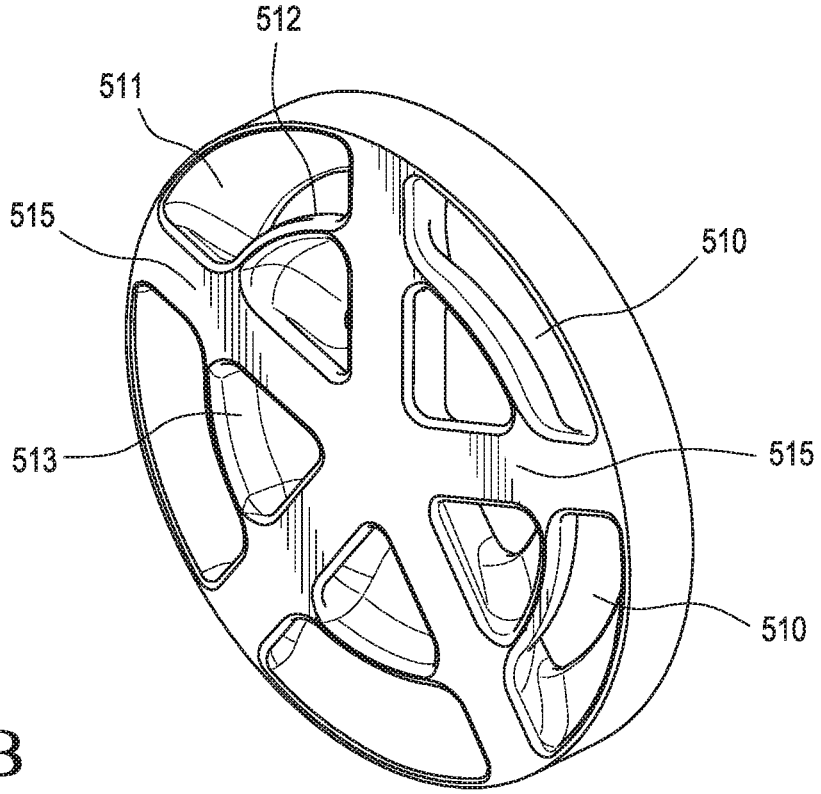
FIG. 5B illustrates a perspective view and FIG. 5C illustrates a rear view of the mixer of FIG. 5A.
Figure 5C:
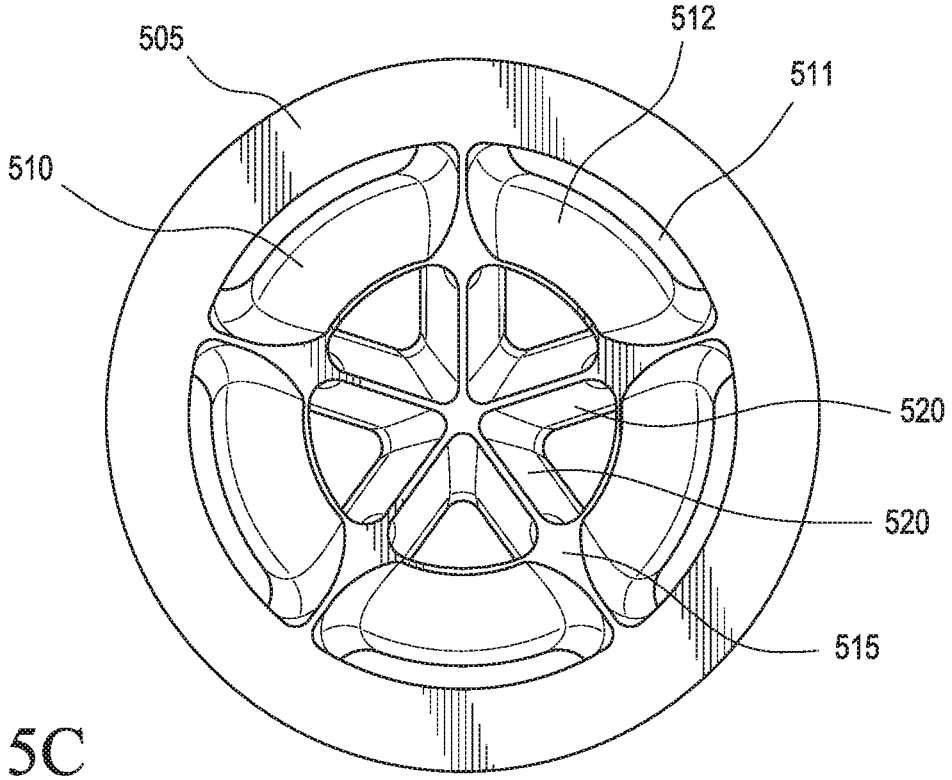

FIG. 5A illustrates a front view of a mixer 500 according to a fifth embodiment of the present invention. The mixer comprises a body 505 having a circular or ring structure. The body comprises a plurality of slots 510 forming an inner concentric ring of slots and an outer concentric ring of slots. The slots are angled with respect to an axis through a center of the body. The slots forming the outer concentric ring have a first concave shaped side 511 and a second wavy side 512; the inner concentric ring of slots have a concave side 513 (FIGS. 5B-5C). A plurality of arms 515 extend from an outer edge or side of the body towards and connect at a center of the body. Each of the plurality of arms 515 has a flat surface on a first side of the body and angled sides 520 along at least a portion thereof extending to a second side of the body (FIG. 5C). The angled sides 520 form sides or part of the inner concentric ring of slots. Respective slots 510 are located between two arms 515 on at least a first side of the body. FIG. 5B illustrates a perspective view of the mixer of FIG. 5A. FIG. 5C illustrates a rear view of the mixer of FIG. 5A.

Figure 6A:
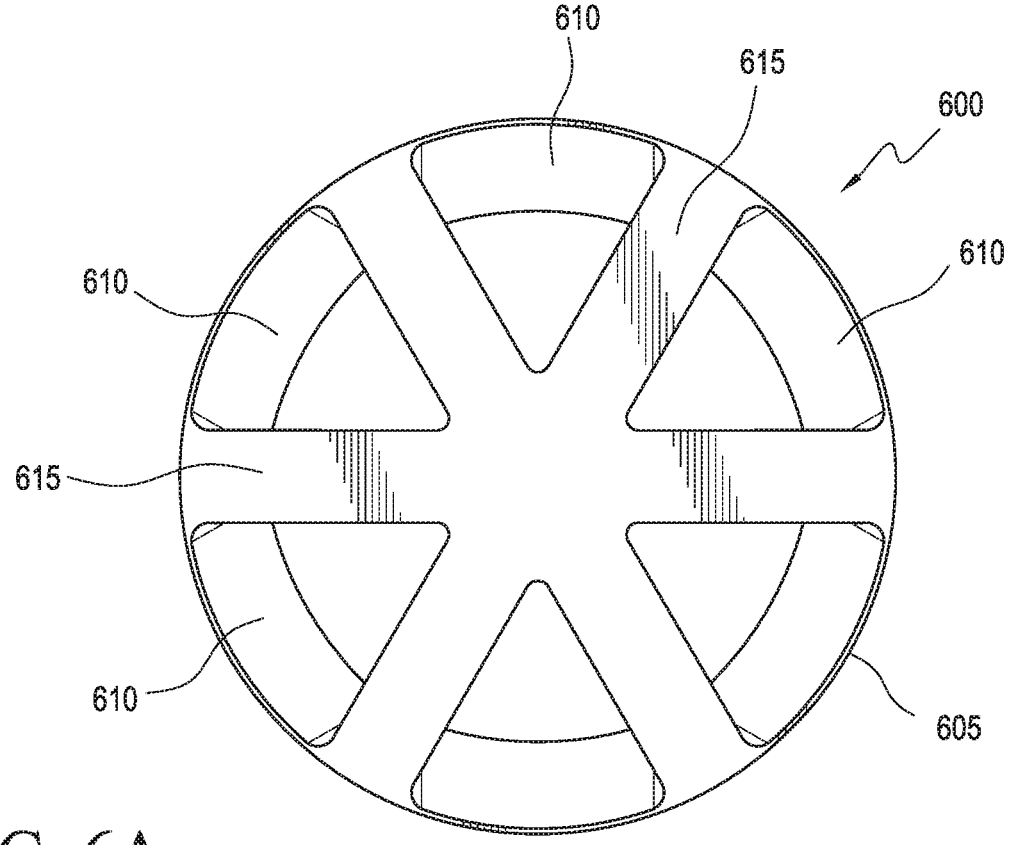
FIG. 6A illustrates a front view of a mixer according to a sixth embodiment of the present invention.
Figure 6B:
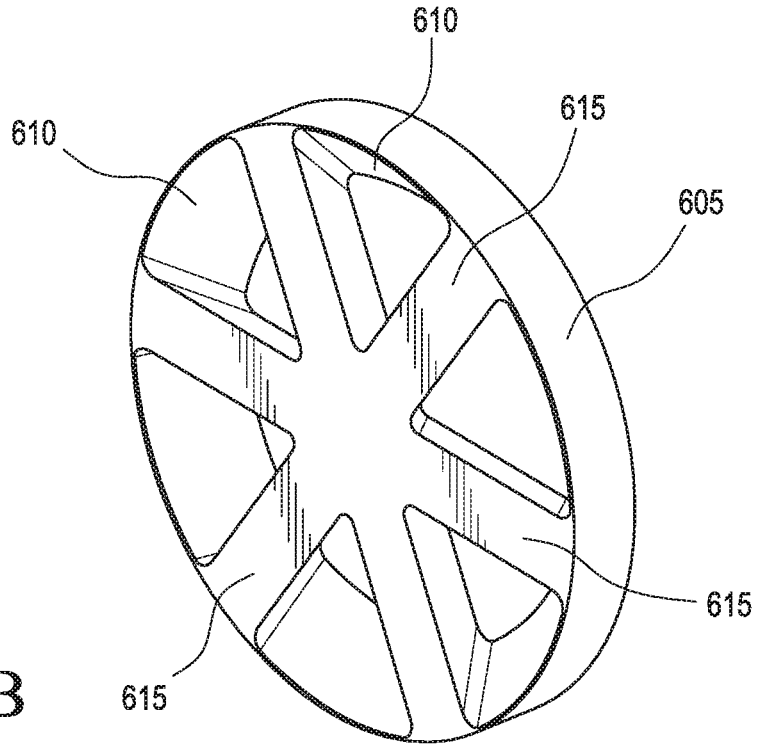
FIG. 6B illustrates a perspective view and FIG. 6C illustrates a rear view of the mixer of FIG. 6A.
Figure 6C:
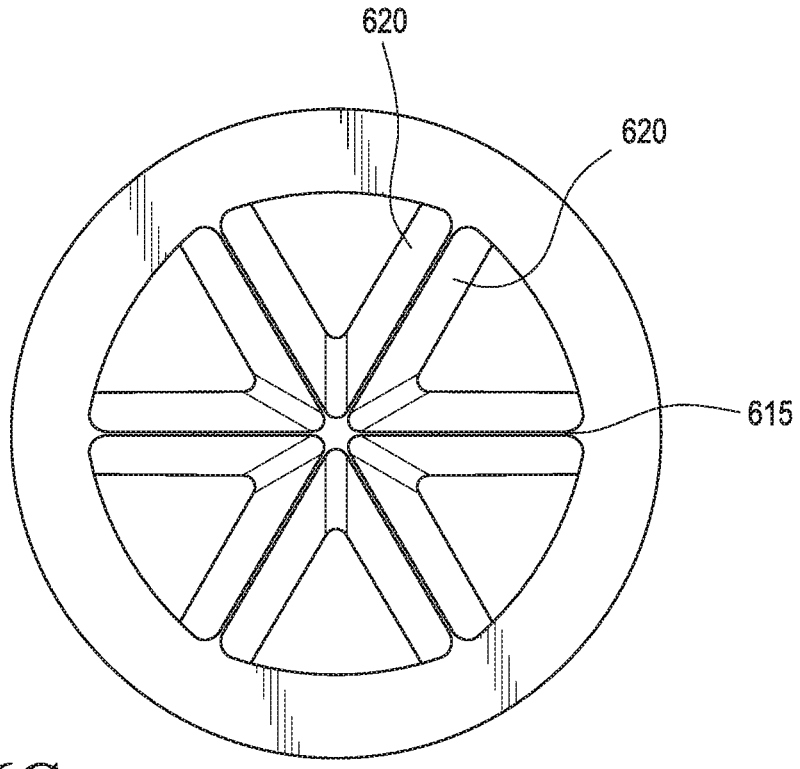

FIG. 6A illustrates a front view of a mixer 600 according to a sixth embodiment of the present invention. The mixer comprises a body 605 having a circular or ring structure. A plurality of arms 615 extend from an outer edge or side of the body towards and connect at a center of the body. Each of the plurality of arms 615 has a flat surface on a first side of the body and angled sides 620 along at least a portion thereof extending to a second side of the body (FIG. 6C). The mixer comprises a plurality of slots 610 forming one concentric ring, each slot being partially defined by a portion of the ring structure that is angled with respect to an axis through a center of the body. FIG. 6B illustrates a perspective view of the mixer of FIG. 6A. FIG. 6C illustrates a rear view of the mixer of FIG. 6A.

FIG. 7 illustrates a perspective view of a mixer 700 according to a seventh embodiment of the present invention. The mixer comprises a body 705 having a circular or ring structure. The body comprises a plurality of slots forming an inner concentric ring of slots 711 and an outer concentric ring of slots 710. Each slot is angled with respect to an axis passing through a center of the body. A plurality of arms 715 extend from an outer edge or side of the body towards and connect at a center of the body. The slots 710 have a curved side and an opposing wavy side. The slots 711 have a substantially triangular shape with a protrusion 717 from one of the arms 715 extending into the slot. Each of the plurality of arms 715 has a flat surface on a first side of the body and may have angled sides extending along at least a portion thereof to a second side of the body. The slots 710, 711 are located between two arms 715 on at least a first side of the body.

Figure 8B:
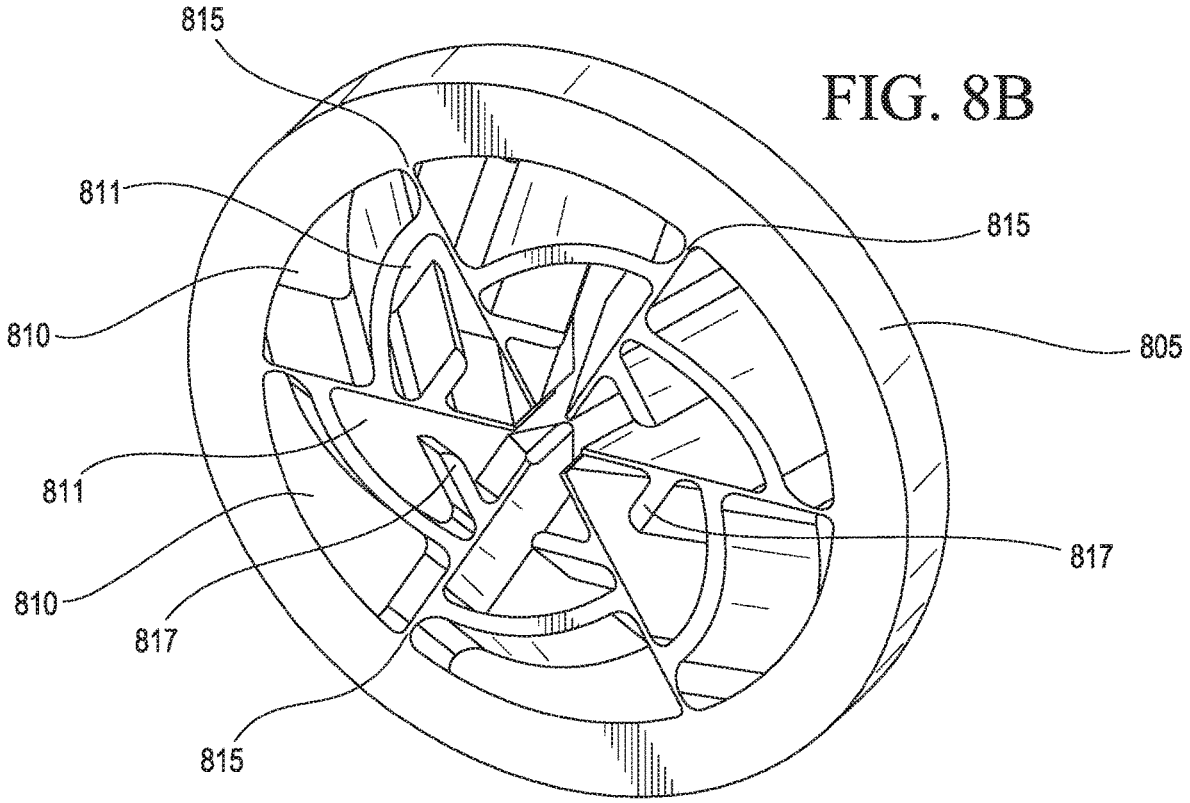
FIG. 8B illustrates a perspective view of the mixer of FIG. 8A.

FIG. 8A illustrates a rear view of a mixer 800 according to an eighth embodiment of the present invention. The mixer comprises a body 805 having a circular or ring structure. The body comprises a plurality of slots forming an inner concentric ring of slots 811 and an outer concentric ring of slots 810. Each slot is angled with respect to an axis passing through a center of the body. A plurality of arms 815 extend from an outer edge or side of the body towards a center of the body, but do not connect or intersect in the center. The slots 810 have curved sides. The slots 811 have a substantially triangular shape with a protrusion 817 from one of the arms 815 extending into the slot. Each of the plurality of arms 815 has a flat surface on a first side of the body and may have angled sides extending along at least a portion thereof to a second side of the body. Respective slots 810, 811 are located between two arms 815 on at least a first side of the body. FIG. 8B is a rear perspective view of the mixer of FIG. 8A.

FIG. 9A illustrates a front view of a mixer 900 according to a ninth embodiment of the present invention. The mixer comprises a body 905 having a circular or ring structure. The body comprises a plurality of slots, forming an inner concentric ring of slots 911 and an outer concentric ring of slots 910. Each slot is angled with respect to an axis passing through a center of the body. A plurality of arms 915 extend from an outer edge or side of the body towards a center of the body, where there is a central hole 916. The slots 910, 911 have at least one curved side. Each inner slot 911 has a protrusion 917 extending from an arm partially into the slot. Each of the plurality of arms 915 has a flat surface on a first side of the body and angled sides extending along at least a portion thereof to a second side of the body. The outer slots 910 and the inner slots 911 are each located between two arms 915 on at least a first side of the body.

The inner slots 911 and/or outer slots 910 have at least one chamfer 920 extending from a first side of the body to a second side of the body. The at least one chamfer 920 helps guide fluid flow through the mixer. In specific embodiments, a chamfer may have a curvature of about 0.2% to 0.7%, for example 0.3%, of the inner pipe diameter into which the mixer is installed. A slot may have two chamfers 920, one chamfer on a first end of the slot and another chamfer on an opposing second end of a slot.

The inner slots 911 and/or outer slots 910 have a flap or lip 925 that extends or curves inwardly from a side of the body (e.g., a downstream side of the mixer once it is installed in a pipeline). In specific embodiments, the flap or lip 925 may have a length that is from about 0.5 to 5% of the length of a slot as measured from a first side of the body to a second side of the body. FIG. 9B illustrates a front perspective view of the mixer of FIG. 9A. FIG. 9C illustrates a rear perspective view of the mixer of FIG. 9A. FIG. 9D illustrates a cross-section view of the mixer of FIG. 9A along the shown line.

FIG. 10 illustrates a perspective view of a pre-mixer 1000 according to a first embodiment of the present invention. The pre-mixer comprises a body 1005 having a circular or ring structure. A first arm 1015 extends a diameter of the body, thereby forming a top portion 1020 and a bottom portion 1025. The top portion 1020 comprises a semicircular slot. Two or more second arms 1018 extend from first arm 1015 towards the bottom of the ring structure and form a plurality of slots 1010, each slot being angled with respect to an axis passing through a center of the body. Each of the arms 1015, 1018 have a flat surface on a first side of the body. The slots may be oriented at the same angle or may be at different angles.

FIG. 11 illustrates a perspective view of second embodiment of a pre-mixer 1100 according to the present invention. The pre-mixer comprises a body 1105 having a circular or ring structure. Two or more arms 1115*a* extend a diameter of the ring structure. Two or more arms 1115*b* intersect arms 1115*a*, respectively, at right angles, thereby forming a plurality of slots 1130. Arms 1115*b* flare near one end, forming a bottom slot 1140, which is in the form of a slot with a wavy top. The arms 1115*a*, 1115*b* have a flat surface on a first side of the body. One or more of the 1130, 1140 slots are angled with respect to an axis passing through a center of the body. The slots may be oriented at the same angle or may be at different angles.

FIG. 12A illustrates a front view of third embodiment of a pre-mixer 1200 according to the present invention. The pre-mixer comprises a body 1205 having a circular or ring structure. Two or more arms 1210 extend the diameter of the ring structure. Two or more arms 1215 extend between arms 1210 and between arms 1210 and the ring structure, thereby forming a plurality of slots 1220. The slots are angled with respect to an axis passing through a center of the body. The slots may be oriented at the same angle or may be at different angles. Slots in outer sections may be oriented at a different angle than or opposing angle to the slots in a central section.

The slots 1220 have at least one chamfer 1250 extending from a first side of the body to a second side of the body. The slots 1220 also have a flap or lip 1240 that extends or curves inwardly from a side of the body (e.g., a downstream side of the mixer once it is installed in a pipeline). FIG. 12B illustrates a front perspective view of the pre-mixer of FIG. 12A. FIG. 12C illustrates a rear perspective view of the pre-mixer of FIG. 12A.

According to the present invention, at least one static mixer, at least one pre-mixer, or any combination thereof may be installed in a fluid flow pipeline. FIG. 13 illustrates a schematic view of a specific embodiment in which a sleeve 1300 includes the mixer 900 of FIG. 9A and the pre-mixer 1200 of FIG. 12A to be installed in a fluid flow pipeline. The sleeve is installed such that the mixer and pre-mixer are in an orientation substantially perpendicular to a longitudinal axis of the fluid flow pipeline. In embodiments, the at least one static mixer and/or at least one pre-mixer may be welded to a fluid flow pipeline or may be mounted in flanges.

FIG. 14 illustrates a schematic view of a pipe assembly 1400 according to an embodiment of the present invention comprising a fluid flow pipeline 1405 and at least one static mixer 1410 (alone or with a premixer) installed in the fluid flow pipe in an orientation substantially perpendicular to a longitudinal axis of the fluid flow pipe. The at least one static mixer 1410 is installed upstream of a sampler 1415. The at least one static mixer may be at any distance upstream of sampler 1415, for example 1D to 10D, or 2D to 5D, where D is the internal pipe diameter. In embodiments, the fluid flow pipe may also include a flow conditioner 1420, positioned upstream and/or downstream of the at least one static mixer. In a specific embodiment, suitable flow conditioners include, but are not limited to, CPA TBR, CPA 50E, CPA 55E®, CPA 60E®, CPA 65E® flow conditioners, available from Canada Pipeline Accessories, Inc. of Calgary, Canada.

VI. INDUSTRIAL APPLICABILITY

The present invention relates to a static mixer comprising a plurality of slots for mixing fluid flow within a pipeline and to a method for mixing fluid flow using the static mixer. The static mixer helps ensure proper mixing of fluid flow within a fluid flow pipeline and therefore to achieve proper performance of a sampling system.

Although the present invention has been described in terms of particular and alternative embodiments, it is not limited to those embodiments. Alternative embodiments, examples, and modifications which would still be encompassed by the invention may be made by those skilled in the art, particularly in light of the foregoing teachings.

Those skilled in the art will appreciate that various adaptations and modifications of the exemplary and alternative embodiments described above can be configured without departing from the scope and spirit of the invention. Therefore, it is to be understood that, within the scope of the appended claims, the invention may be practiced other than as specifically described herein.

The invention claimed is:

1. A pre-mixer for mixing fluid flow in a pipeline, comprising:

a body having a ring structure;

two first arms parallel to each other, each first arm extending straight across the ring structure with opposing ends connecting to the ring structure, two or more second arms, each second arm extending from the ring structure to a side of a first arm facing the ring structure, thereby forming a first set of slots, and two or more third arms, each third arm extending between opposing sides of said two first arms, thereby forming a second set of slots.

2. A pre-mixer according to claim 1, wherein one or more sides of the plurality of slots is straight, wavy, or a curved.

3. A pre-mixer according to claim 1, wherein one or more slots further include a chamfer extending from a first side of the body to a second side of the body.

4. A pre-mixer according to claim 1, wherein one or more slots further include a lip or flap that curves inwardly from a side of the body.

5. A method of mixing fluid flow within a fluid flow pipeline comprising mixing a fluid within the fluid flow pipeline with a pre-mixer according to claim 1.

6. A pre-mixer according to claim 1, wherein each slot is angled with respect to a longitudinal axis of a pipeline in which the pre-mixer is installed.

7. A pre-mixer according to claim 1, wherein each slot is angled with respect to an anterior-posterior axis passing through a center of the body which is perpendicular to a vertical axis passing through a center of the body.

8. A pre-mixer according to claim 7, wherein the first set of slots is oriented at a different angle than the second set of slots.

9. A pre-mixer according to claim 1, wherein, between a front face of the pre-mixer and a rear face of the pre-mixer, the first set of slots is oriented at a different angle than the second set of slots with respect to an axis passing through a center of the front face and the rear face.

10. A mixer according to claim 9, wherein, between a front face of the mixer and a rear face of the mixer, the first set of slots is oriented at a different angle than the second set of slots and the third set of slots with respect to an axis passing through a center of the front face and the rear face such that as a fluid flows between the front face and the rear face settled matter in the fluid is diverted in an upward direction.

11. A pre-mixer for mixing fluid flow in a pipeline, comprising:

a body having a ring structure;

first arms parallel to each other, each first arm extending across the ring structure, opposing ends of the first arms connecting to the ring structure;

two or more second arms parallel to each other, each second arm extending from the ring structure to a side of each first arm facing the ring structure, thereby forming a first set of slots; and third arms parallel to each other, each third arm extending between opposed facing sides of the first arms, thereby forming a second set of slots.

12. A pre-mixer according to claim 11, wherein the first set of slots is oriented at a different angle than the second set of slots.

13. A pre-mixer according to claim 11, wherein each slot of the first set of slots and the second set of slots comprises a chamfer at a corner of said slot extending from a first side of the body to a second side of the body.

14. A pre-mixer for mixing fluid flow in a pipeline, comprising:

a body having a ring structure;

two first arms parallel to each other and extending straight across the ring structure, opposing ends of each first arm connecting to the ring structure;

two or more outer arms, opposing ends of each outer arm extending from the ring structure to a side of a first arm facing the ring structure, thereby forming outer slots between the ring structure and the two first arms; and two or more central arms extending between opposed facing sides of the two first arms, thereby forming inner slots between the two first arms.

15. A pre-mixer according to claim 14, wherein the outer slots have a different angle than the inner slots.

16. A pre-mixer according to claim 14, wherein the outer slots and the inner slots each comprise a chamfer at a corner of said outer and inner slots extending from a first side of the body to a second side of the body, wherein the chamfer is curved.

17. A pre-mixer according to claim 16, wherein the chamfer has a curvature of about 0.2% to 0.7% of an inner pipe diameter into which the mixer is installed.

18. A mixer for mixing fluid flow in a pipeline, comprising:

a ring structure;

a central region defined by a) two or more parallel first arms extending across the ring structure and b) two or more second parallel arms, each second arm extending between said two or more parallel first arms, thereby forming a first set of slots;

a first side region defined by two or more parallel third arms, each third arm extending from the ring structure to a side of one first parallel arm facing the ring structure, thereby forming a second set of slots; and a second side region defined by two or more parallel fourth arms, each fourth arm extending from the ring structure to a side of a second first parallel arm facing the ring structure, thereby forming a third set of slots.

* * * * *